US006740802B1

(12) United States Patent
Browne, Jr.

(10) Patent No.: US 6,740,802 B1
(45) Date of Patent: May 25, 2004

(54) INSTANT MUSICIAN, RECORDING ARTIST AND COMPOSER

(76) Inventor: Bernard H. Browne, Jr., 240 Sand Key Estates Dr. #68, Clearwater, FL (US) 33767-2932

( * ) Notice: Subject to any disclaimer, the term of this patent is extended or adjusted under 35 U.S.C. 154(b) by 0 days.

(21) Appl. No.: 09/655,792

(22) Filed: Sep. 6, 2000

(51) Int. Cl.[7] ..... G10H 1/00
(52) U.S. Cl. ..... 84/609; 84/622
(58) Field of Search ..... 84/609–614, 622–625, 84/477 R, 478

(56) References Cited

U.S. PATENT DOCUMENTS 4,538,495 A * 9/1985 Sato ..... 84/478 X
4,945,804 A * 8/1990 Farrand ..... 84/478 X
5,092,216 A * 3/1992 Wadhams ..... 84/602
5,565,641 A * 10/1996 Gruenbaum ..... 84/615
5,646,648 A * 7/1997 Bertram ..... 345/168
5,728,962 A * 3/1998 Goede ..... 84/609
5,908,997 A * 6/1999 Arnold et al. ..... 84/615
5,990,404 A * 11/1999 Miyano ..... 84/609
6,063,994 A * 5/2000 Kew et al. ..... 84/600
6,066,795 A * 5/2000 Hara ..... 84/645
6,075,193 A * 6/2000 Aoki et al. ..... 84/609
6,084,168 A * 7/2000 Sitrick ..... 84/477 R
6,124,543 A * 9/2000 Aoki ..... 84/609
6,143,971 A * 11/2000 Aoki et al. ..... 84/609
6,201,174 B1 * 3/2001 Eller ..... 84/477 R
6,392,135 B1 * 5/2002 Kitayama ..... 84/622

* cited by examiner

*Primary Examiner*—Robert Nappi
*Assistant Examiner*—David Warren

(57) ABSTRACT

"The Instant Musician, Recording Artist and Composer" permits ordinary computer users to select an instrument and music number from their computer screen and immediately start playing the selected instrument by simply typing letters displayed on their computer screens. It also may serve as a learning tool for learning how to play classical instruments by depicting the physical parts of the instrument to be activated with each note entered into the keyboard. Additional features allow personal computer user to make recordings of multiple instruments (and voice) numbers with altered sound spectrum, if desired, as well as composing their own music by simply clicking a mouse, modifying other music scores, humming, whistling or any other sound input.

14 Claims, 28 Drawing Sheets

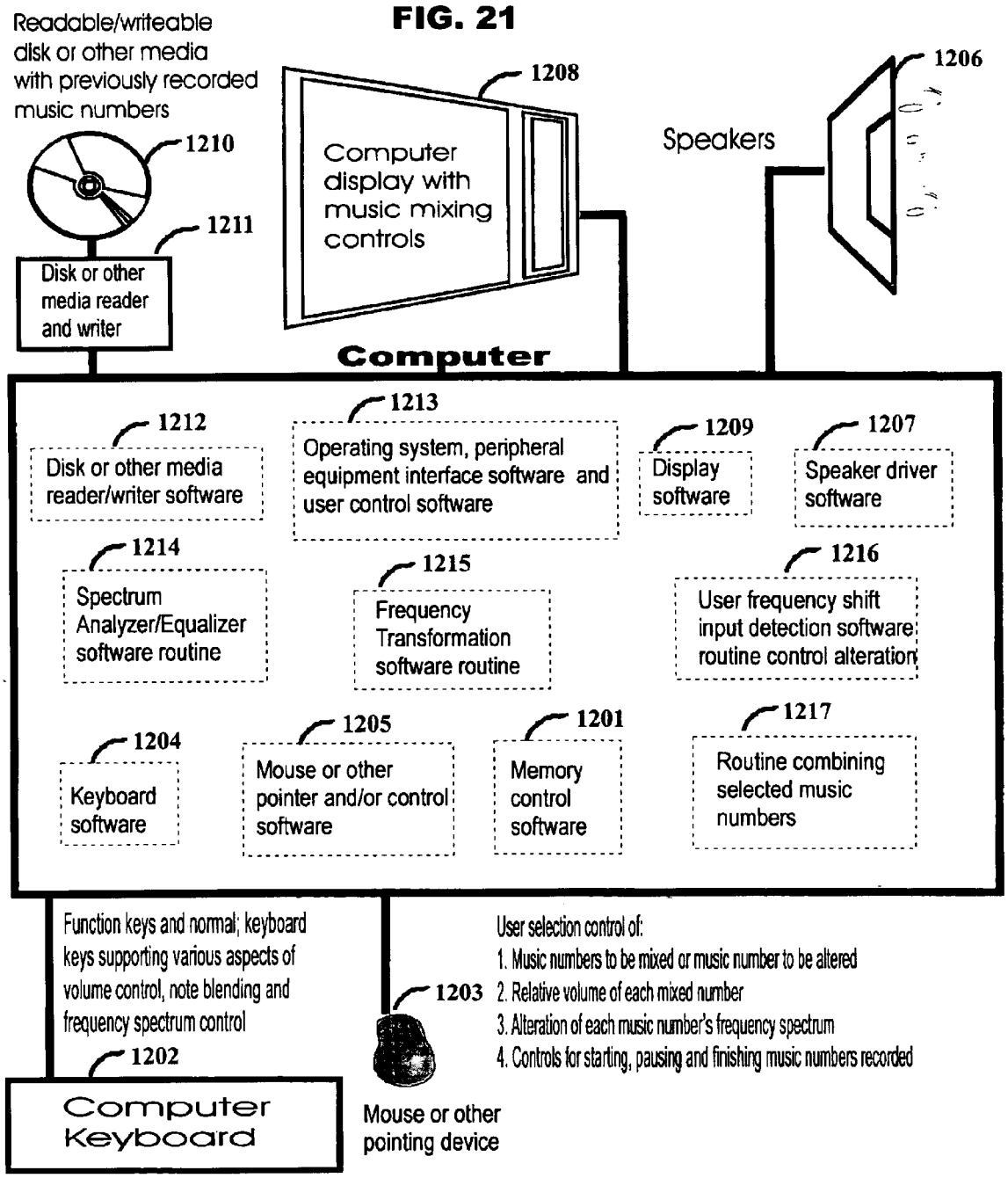
FIG. 21
Readable/writeable disk or other media with previously recorded music numbers
1210
1211
Disk or other media reader and writer
1208
Computer display with music mixing controls
Speakers
1206
Computer
1212
Disk or other media reader/writer software
1213
Operating system, peripheral equipment interface software and user control software
1209
Display software
1207
Speaker driver software
1214
Spectrum Analyzer/Equalizer software routine
1215
Frequency Transformation software routine
1216
User frequency shift input detection software routine control alteration
1204
Keyboard software
1205
Mouse or other pointer and/or control software
1201
Memory control software
1217
Routine combining selected music numbers
Function keys and normal; keyboard keys supporting various aspects of volume control, note blending and frequency spectrum control
1202
Computer Keyboard
1203
Mouse or other pointing device
User selection control of:
1. Music numbers to be mixed or music number to be altered
2. Relative volume of each mixed number
3. Alteration of each music number's frequency spectrum
4. Controls for starting, pausing and finishing music numbers recorded

INSTANT MUSICIAN, RECORDING ARTIST AND COMPOSER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of Invention

The present invention relates to the field of music. More particularly, the present invention relates to a completely integrated total music system allowing users with no music experience to immediately begin playing computerized digital equivalents of any instrument from their computer, transform frequencies and alter the amplitude characteristics of any digital music, combine digital music files with weighted frequency transformed and amplitude modified sound characteristics, and easily compose new music numbers by any of several means including: humming, singing, whistling, typing, manipulating a mouse or pointing device, typing on a standard computer keyboard or by altering previously composed music scores or recorded music files.

2. Description of Prior Art

Previously, there has been no integrated music tool that permits people totally inexperienced in reading music scores and totally inexperienced with how to play any musical instrument to immediately begin: a) playing any music score for any musical number with the computerized equivalent of any classic instrument, b) completely altering sound characteristic of any musical number by transforming frequencies, adjusting amplitudes and combining weighted music files, and c) composing and recording new music numbers by several easy methods.

Relative to the "Instant Musician" aspect of this invention, the playing of classical music instruments has required users to learn how to read music scores and then to translate these scores into particular coordinated body motions that produce the sounds on the particular instrument. And, the classical instrument had to be accessible to the user. Other than a few keyboard instruments, like pianos and organs, most body efforts to produce the desired sounds on different instruments are quite different—like the difference between trumpets and drums, for example. The process of learning how to play classical music instruments is complicated by the complexity of reading and interpreting music scores for different instruments. The proper reading and interpretation of music scores requires the learning of numerous music symbols including: measures, phrases, octaves, chords, altered chords, melodies, harmonic intervals, staffs, note beat timing numbers, note duration variations, intervals, sharps, flats, fortes, mezzo fortes, slurs, legatos, note rests, and tied notes.

Relative to the "Recording Artist" aspect of this invention, apparatus for mixing previously recorded music numbers created from individual instruments, combined instruments or singers are well known, and many devices employ "equalizers" to modify sound amplitudes in selected frequency ranges. While equalizers and even more complex computerized versions of these can combine and modify music segments or total performances by attenuating and/or amplifying various components of a music number, they cannot transform sounds of individual instruments, multiple instruments or singers into sounds comprising totally different frequency spectrums containing different or new frequencies so that previously recorded efforts may be transformed into completely different sounds.

Relative to the "Instant Composer" aspect of this invention, there are computerized methods for composing new music scores including point and click software that adds notes to blank music scores as well as computer programs drawing on databases of melodies, harmonies and melodic phases to construct new music numbers.

BRIEF SUMMARY OF THE INVENTION

The present "Instant Musician, Recording Artist and Composer" invention encompasses a complete integrated music system that enables persons with only basic computer skills and no music background or knowledge to immediately play any music number using the computerized equivalent of any known musical instrument, record and transform their music playing or singing into combined results having completely transformed sounds, and to most easily allow users to compose new music numbers by a variety of most simple means, such as, humming, ad hoc singing or by modifying sample music scores.

According to the "Instant Musician" aspect of the present invention, music scores are presented in such a way on computer screens that anyone with only basic computer skills is instantly capable of playing any musical number producing the computerized equivalent sounds of any musical instrument. All that is required of the user is to select a music number they would like to play, select an instrument sound from a list, and then type the letters designated on the computer screen using a standard computer keyboard. If the song or music number selected begins with the notes e, g, a and b in the first measure, for example, all the user has to do to play the selected music number is to type e, then g, then a, and then b as prompted by the computer screen. This then generates the corresponding musical note sounds of the selected musical instrument whether the instrument sound selected was a piano, trumpet, guitar or other instrument selected. The musical note sounds of the selected instrument are obtained from note sound samples of each musical instrument stored in the computer's memory apparatus. Music effects represented on conventional sheet music using symbols, such as, sharps, flats fortes, mezzo fortes, ties, slurs and others plus changes in octaves are represented on the screen via additional conventional computer keyboard keys beyond keys A thru G in one octave of music. These additional keys used for these music effects include use of the shift key for capital letters, symbol keys, number keys, tab keys, arrow keys, Alt and Ctrl keys, as well as function keys. This aspect of the invention eliminates the chore of learning how to play various musical instruments and the chore of learning how to read music scores.

According to another aspect of the "Instant Musician" feature of the present invention, places on the instrument selected that correspond to the note to be played are also designated or highlighted. This speeds the process of learning to play conventional musical instruments in a traditional sense if desired. If piano sounds have been selected to be played by the user and the music piece selected to be played starts with a "g" note, for example, a piano keyboard image additionally will be shown on the screen with a piano key corresponding to the note "g" designated or highlighted. In accordance with still another embodiment of this feature of the present invention, the user may click a computer mouse or other pointing device on the designed place on the instrument depicted on the computer display to produce the sound corresponding to the note to be played.

According to the "Instant Recording Artist" aspect of the present invention, users may record, transform musical frequencies and amplitudes, and combine different versions of musical material that have been previously created including music pieces that have been sung. The sound spectrum of individual or combined instruments or human voices are transformed by bending the shape of a frequency spectrum section of the computer display with the movement of a computer mouse or other pointing device. By transforming the frequency spectrum composition of individual elements recorded or combined musical pieces, the user may create sound effects that cannot be rendered by humans or by use of known conventional music instruments. These music creations may be recorded (computer's drive (s), and/or CDs and/or other recording media) and replayed.

According to the "Instant Composer" aspect of the present invention, users without any musical knowledge or skills may easily compose new musical numbers by a variety of means. In accordance with one aspect of the "Instant Composer" aspect of this invention, the user may click a computer mouse or other pointing device on a music staff displayed on the computer screen to place a musical note on the staff and create the sound corresponding to the note entered via a musical instrument selected. Various music staffs or scores with various time signatures or various degrees of completeness—including even complete prior recorded music scores—may be selected initially by the user prior to entering or altering notes. Composing by altering prior music scores is done by either dragging notes from one part of the music staff to another with a mouse or other pointing device, or by deleting and adding notes using computer keyboard keys. To enable users to rapidly assess and change their music number being created as they progress along through staff sections or measures, several music playback options are provided in terms of buttons to click on the screen (Play Back 2 seconds, Play Back 5 seconds . . . , Play Back Whole Number). Like the "Instant Musician" aspect of this invention, users may select or change the musical instrument that sounds when a note is entered on the music staff or when a note is replaced on the staff.

In accordance with another embodiment of the "Instant Composer" aspect of this invention, a user may enter sounds into the computer via a microphone that will automatically generate notes in the music staff displayed on the screen. Sounds for composing music may be created by humming, singing, whistling, clapping or by use of any device that creates sounds. The music scores created by any of these means may by altered by adding, deleting or changing the location of notes in scores displayed on the computer display.

BRIEF DESCRIPTION OF THE DRAWINGS

FIG. 21 shows a block diagram of the key elements of the "Recording Artist" aspect of the present invention;

DETAILED DESCRIPTION OF THE INVENTION

Structure of the Overall System Embodiment

While this invention is susceptible of embodiment in many different forms, the drawings to be described herein are to be considered an exemplification of the principles of the invention and are not intended to limit the invention to the specific embodiments illustrated.

In accordance with the teachings of the present invention, a system and methodology are provided for allowing novice computer users with no prior music knowledge, including children, to become instant musicians, instant music recording artists and instant music composers. In accordance with the teachings of the "Instant Musician" aspect of the present invention, ordinary computer users with no prior music knowledge may immediately begin playing any musical song or musical number using any musical instrument sounds of their choice. As indicated in the highly simplified diagram of the overall system in FIG. 1, all the user has to do to play the musical sounds of any musical instrument is to: 1a) pick a song, 1b) pick an instrument, and 1c) type letters projected on a display with a standard computer keyboard, or click a mouse or other pointing device. In accordance with the teachings of the "Instant Recording Artist" aspect of the present invention, novice computer users with no prior music knowledge may immediately begin recording their musical efforts, including their voice inputs, in either single instrument sound form or combined individual recording form with either original or significantly modified music amplitude and/or transformed frequency spectrum modifications. As indicated in the highly simplified diagram of the overall system in FIG. 1, all the user has to do to create combined sounds of multiple prior musical efforts with completely different frequency and amplitude characteristics is to: 2a) modify music amplitudes and transform frequencies, 2b) combine recording sounds, and 2c) record and modify again, if desired. In accordance with the teachings of the "Instant Composer" aspect of the present invention, novice computer users with no prior music knowledge may immediately begin composing their own music numbers complete with sounds and music scores by simply inputting tunes or melodies by whatever means is easiest to them including: modification of previously written music scores, singing or humming or other sounds captured by microphone, or by pointing and clicking the addition of music notes on basic music scores. As indicated in the highly simplified diagram of the overall system in FIG. 1, all the user has to do to compose new musical numbers or music scores is to: 3a) Compose by pointing & clicking, humming and/or singing or other sound input, 3b) Click to replay and modify various length recorded music segments.

Figure 1:
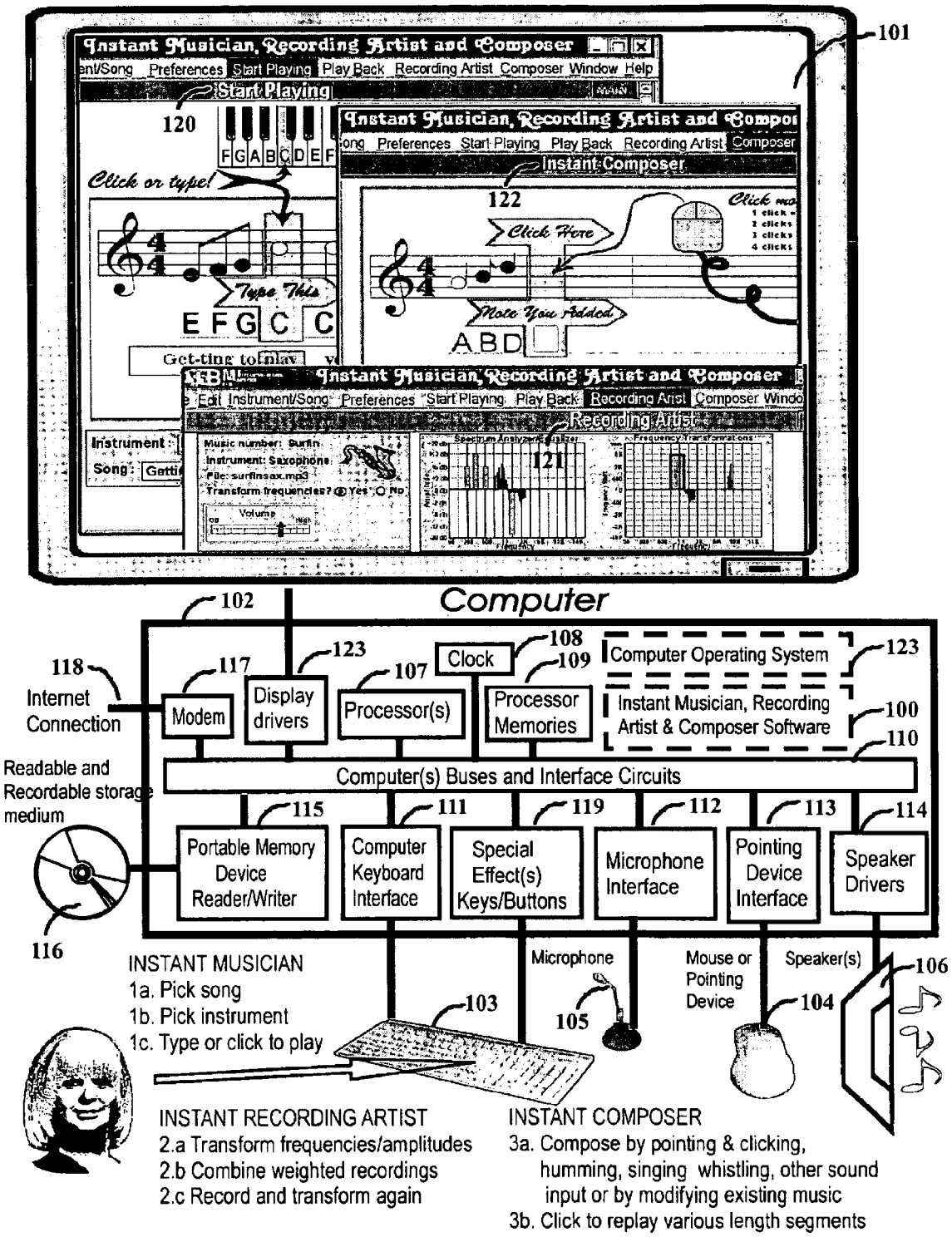
FIG. 1 shows partial overviews of displays for the "Instant Musician," "Instant Recording Artist," and "Instant Composer" aspects of the present invention along with a higher level block diagram depicting general hardware and software elements of the overall system in accordance with the present invention.

FIG. 1 shows partial views of displays of the "Instant Musician," "Instant Recording Artist," and "Instant Composer" aspects of the present invention along with a high level block diagram depicting general hardware and software elements of the overall system in accordance with the present invention. Hereafter, the combined completely integrated "Instant Musician," "Instant Recording Artist," and "Instant Composer" aspects of the present invention shall be referred to as the "system" simply for the purpose of brevity.

A simplified diagram of the overall "system" is shown in FIG. 1. Principal elements of the system include the software routines of the of "Instant Musician, Recording Artist and Composer" (100), a display (101), a computer or computers (102), a computer keyboard (103), a computer mouse or pointing device (104), a microphone or other sound pickup device (105), and speakers or earphones for listening to sounds generated by the computer (106). The computer or computers (102) may be a personal computer (PC), workstation, laptop computer or miniaturized portable device capable of performing most of the operations of the computer operating system (123) and the "Instant Musician, Recording Artist and Composer" system software (100).

The computer (102) shall contain an internal processor or processors (107) that work in conjunction with an operating system (123), an internal processor clock (108) and processor memories (109). The computer's non-volatile and volatile memories shall include, but not be limited to, hard disk drives, RAM and ROM. The computer operating system (123) can be either a type commonly referred to as a "Windows," Unix, "Linux" or "Apple", or any operating system compatible with popular versions of these stated operating systems, or operating systems offering similar capabilities. The computer operating system (123) communicates with the computer's internal busses and interface circuits (110) permitting the computer to process data from or to the computer's keyboard interface hardware and software (111), mouse or other pointing device interface hardware and software (113), a microphone or other sound pickup device interface hardware and software (112), and the interface software and hardware (114) for the computer's built-in speakers, external speakers (106) or audio headsets.

The computer (102) shall either have a built-in portable memory device reader and writer (115) or be capable of interfacing and properly operating with an external portable memory storage device. Portable memory devices are high density magnetic, electro-optical or optical floppy disks, compact disks (CDs), ZIP drive disks, Digital Video Disks (DVDs) or any high density device capable of storing music data used by the system and capable of accepting music data generated by the system for storage. In one embodiment shown, the portable memory device is a read and write compact disk or CD-RW or CD-R/RW (116). The portable memory device is one means for loading the system operational software of the "Instant Musician, Recording Artist and Composer" into the computer (102) and providing the data for the computer screen displays.

Included in the apparatus of the present embodiment is a modem (117) either built-in or external to the computer (102) that is capable of communicating with the inventor's Web site on the Internet (118). Communication with the Internet may be either via standard phone lines, digital subscriber lines (DSLs), cable modems, or wireless Internet connections. The inventor's Web site is a source for accessing and downloading system software, additional music data (musical number or song data and musical instrument sound data) and system software updates.

While no special computer keyboards are used in the present embodiment to play music numbers, the system does use keyboard keys beyond alphanumeric keys including: function keys normally labeled F1 Through F12, numerical keys, keys for symbols (~, !, @, #, $, %, %, ^, ^, &, &, *, *, (,), _, {,}, [<], |, \, <, >., ! and others) plus keys (+), minus keys(−), shift keys, control keys (Ctrl), arrow keys, page up (PgUp), page down keys (PgDn), delete (Del) and insert (Ins) keys and all other keys on standard keyboards via the computer's keyboard hardware and software interface (111) or special key/button interface hardware and software (119). These additional keys, per preferences selected by the system user, activate various music conditions including: note durations (⅛ note, etc.), tied notes, sharps and flats, piano for softness, forte for loudness, mezzo forte, and shift of scales, change of octaves, note shifts, measures changes, or other music changes required that simulate the functioning of any musical instrument playing any possible notes, rhythms, or melodies.

The present apparatus includes a display device (101) which may be a cathode ray tube (CRT), liquid crystal display (LCD), or light emitting diodes (LEDs) or devices with similar ability for digital information from the computer.

The system software (100) of the preferred embodiment includes three principal user interface windows including: the Instant Musician Window (120), the Instant Recording Artist Window (121) and the Instant Composer Window (122), each of which will be described in following paragraphs.

Figure 2:
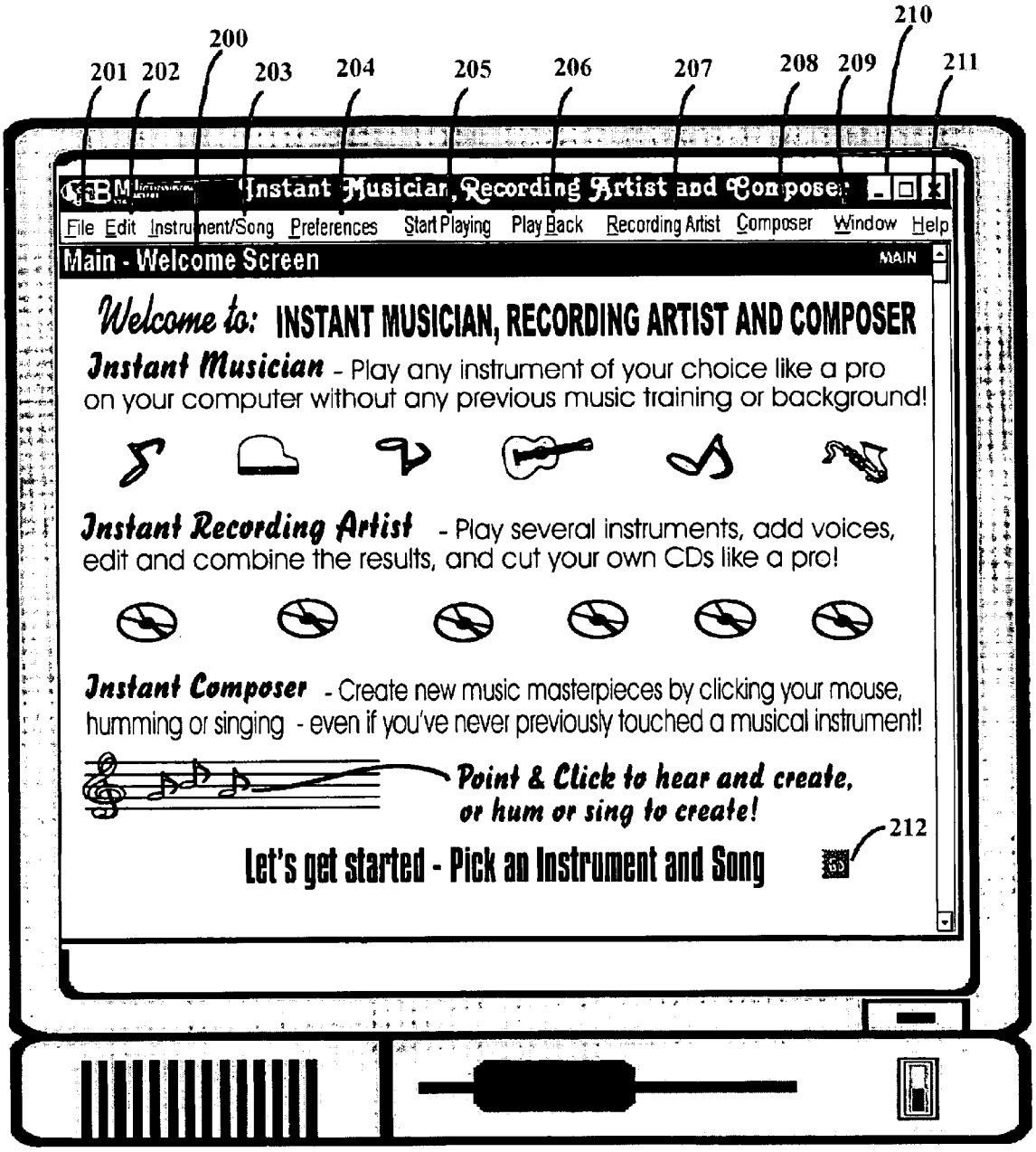
FIG. 2 shows one embodiment of the initial display presented to a user in accordance with the present invention.

FIG. 2 shows an initial display of the system software (100) or user welcoming display window (200) in the preferred embodiment that guides users to the different operational parts of the system. A feature selection portion of the display, or main menu bar, is located near the top of the display that guides users access to different features of the system, Sub-menus on the main menu bar may be accessed by use of a pointing device or by depressing keyboard alphanumeric characters F, E, I, P, S, B, R C W and H while simultaneously holding down the Alt key on a standard computer keyboard.

The File Menu (201) in the preferred embodiment includes a list of file manipulation operations that are typically included in software running under the software operating systems (123) previously mentioned including as a minimum the following file operations: Open, Close, Save, Save As, Play and Print. Clicking a mouse (104), other pointer or typing an appropriate alphanumeric letter along with the Alt key initiates the indicated action on a computer file. Music related files are saved in many different analog and digital formats including as a minimum: MP3, MIDI, MID, and WAV.

Clicking on the Edit Menu (202) on the main menu bar in the preferred embodiment includes a list of system edit operations that are also typically found as part of the operating systems previously mentioned including: Undo (last user action), Redo (last user operation using the Undo operation), Cut, Copy, Paste, Find and Replace, Go To and Settings. Like the File Menu items and all other menu items to be described, items are selected by a mouse or other pointing device (104), or by simultaneously typing the appropriate letter key along with the Alt key which will be hereafter implied as an alternate action by the statement that items are simply "selected" or by "clicking."

Figure 3:
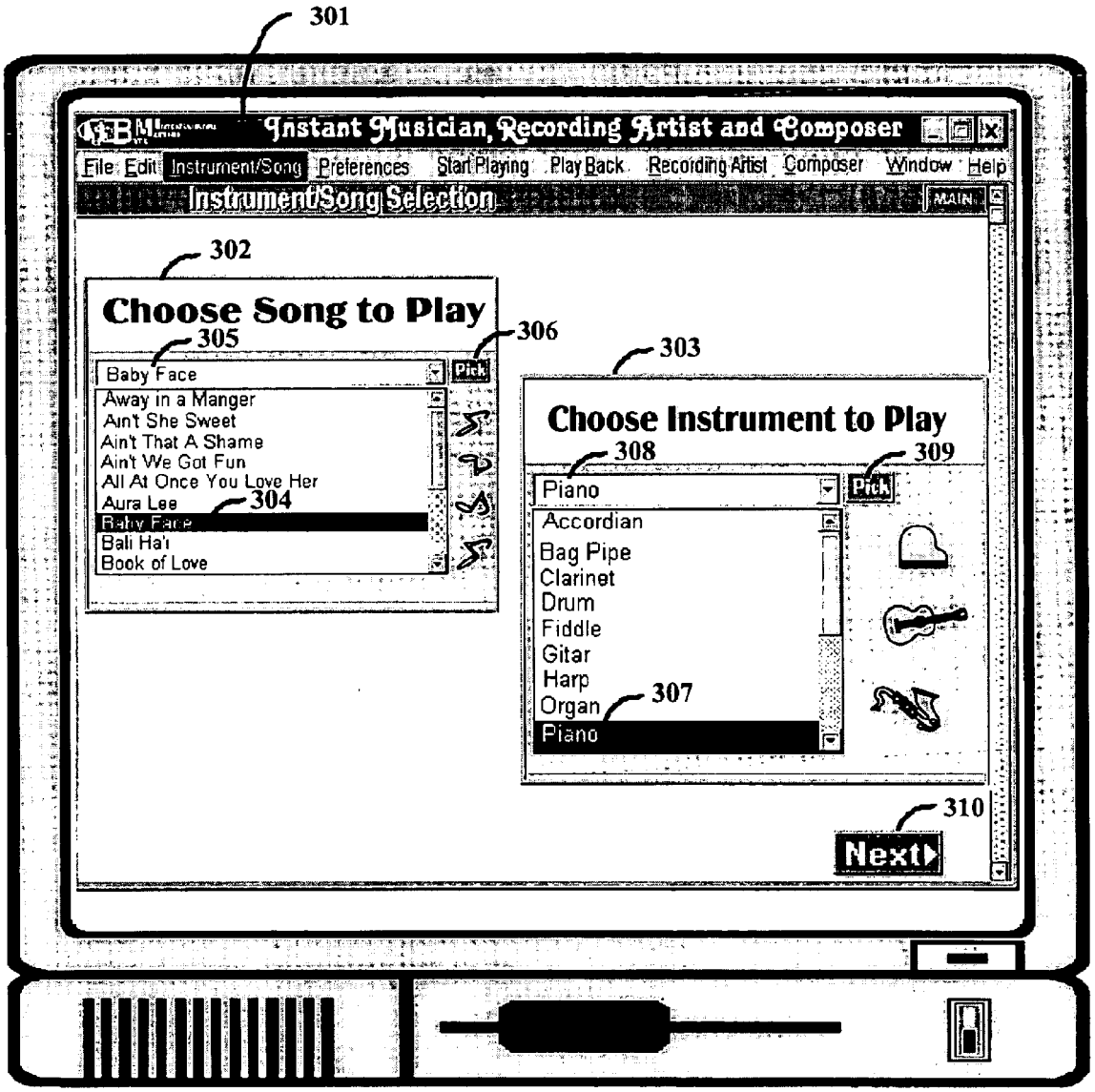
FIG. 3 shows one embodiment of the musical instrument and song selection display applicable to several aspects of the overall music system.

Clicking on the Instrument/Song Menu (203) on the main menu bar in the preferred embodiment brings up the Instrument and Song selection display shown in FIG. 3 which will be elaborated on shortly. Similarly, clicking on the Preferences Menu (204) on the main menu bar in the preferred embodiment brings up the Preferences screen shown in FIG. 5, clicking on the Start Playing menu item on the main menu bar brings up the Instant Musician start playing display shown in FIG. 6, clicking the Play Back item brings up the Play Back display shown in FIG. 14, clicking on the Recording Artist item on the main menu bar brings up the Recording Artist display shown in FIG. 15, and clicking on the Composer main menu bar item brings up the Composer display shown in FIG. 22.

In a preferred embodiment of the present invention, there is Window menu (209) on the main menu bar. This Window menu permits users of the music system to migrate to other open applications on their computer while using this music system and to rearrange screen displays of open applications by tiling (top to bottom, or side by side) or cascading display windows. Minimizing the Instant Musician, Recording Artist and Composer software window with the minimize control (210) still permits users to listen to music numbers they have selected to play whether these music numbers are ones they composed or music numbers they simply selected to play with a particular music instrument sound of their choice.

The last item on the main menu bar is the Help menu item (211) similar to what is contained in most common software programs. Items on the help menu include detailed help for each menu item previously described (File, Edit, Instrument/Song, Preferences, Start Playing, Play Back, Recording Artist, Composer and Window) in the form of detailed text documents with many subcategories in each main help area.

Exiting a given category brought up via the main menu bar may be done any time by choosing another menu item from the main menu bar. Another means of progressing on with playing music is provided on the bottom of the main display screen in the form of a "Go" button (212). Migrating to this portion of the display and clicking a mouse or other pointing device brings up the "Instrument/Song" display shown in FIG. 3.

Instrument and Song Selection

Figure 6:
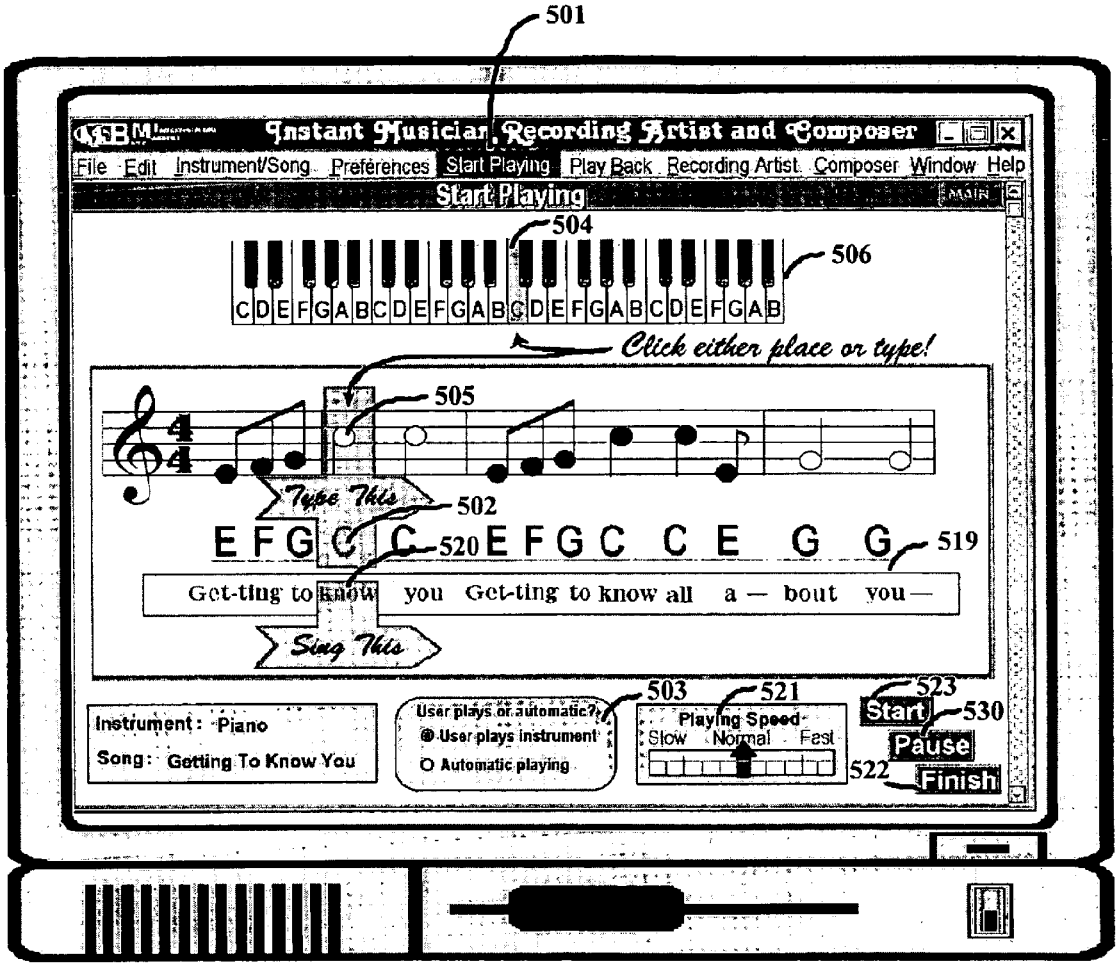
FIG. 6 shows one embodiment of the "Instant Musician" "Start Playing" display of the present invention where the user may immediately begin to play or sing a selected music number with his or her selected musical instrument sounds.

In accordance with one aspect of the invention, FIG. 3 shows an Instrument and Song selection display. The Instrument/Song selection display window (301) is made to appear by selecting the Instrument/Song item from the main menu bar or by actuating the "Go" button (212) from the welcoming display (FIG. 2). In a preferred embodiment, the selection of a musical instrument and song applies to two different modes of operation: 1) the user generates the sounds of the selected instrument choice by typing on the computer keyboard (103) or clicking on an instrument shown on the display with a mouse (104) or other pointing device, or by 2) automatic playing of the selected music number or song using the selected instrument sounds. The difference between these two operating modes and their means of operating will be described later when the "Start Playing" menu item is described (FIG. 6).

To play a particular music number, a song is chosen from the "Choose Song to Play" list box (302) shown in FIG. 3. In the example shown, the music number or song "Baby Face" has been highlighted (304) and brought into the selection area (305) by clicking on "Baby Face" in the list box. Clicking on "Pick" (306) then prepares the system to present this music number to the user for playing or to prepare this music number for automatic playing. A second item to be selected by the user is the particular music instrument to play (303) although one option that can be selected is "None" in the event that the user wishes simply to sing a music number with no musical accompaniment. Other "instrument options" included in one embodiment of the present invention are computer generated voices (soprano, baritone, etc.) that "sing" or speak the words of the music automatically. It will later be seen that these computer generated voices may be significantly altered to sound quite differently using the frequency transformation embodiment of the Recording Artist function of the present invention shown in FIG. 17.

In the example shown, a piano has been highlighted (307) and brought to the selection area (308) by clicking on "piano" in the list box. Clicking on "Pick" (309) then prepares the system to translate user input keystrokes or mouse clicking actions into piano note sounds or to play the music automatically using piano note sounds. It is noted that the order of selecting a song and instrument is not important and thus an instrument may be chosen first before a song or music number is selected.

Figure 4:
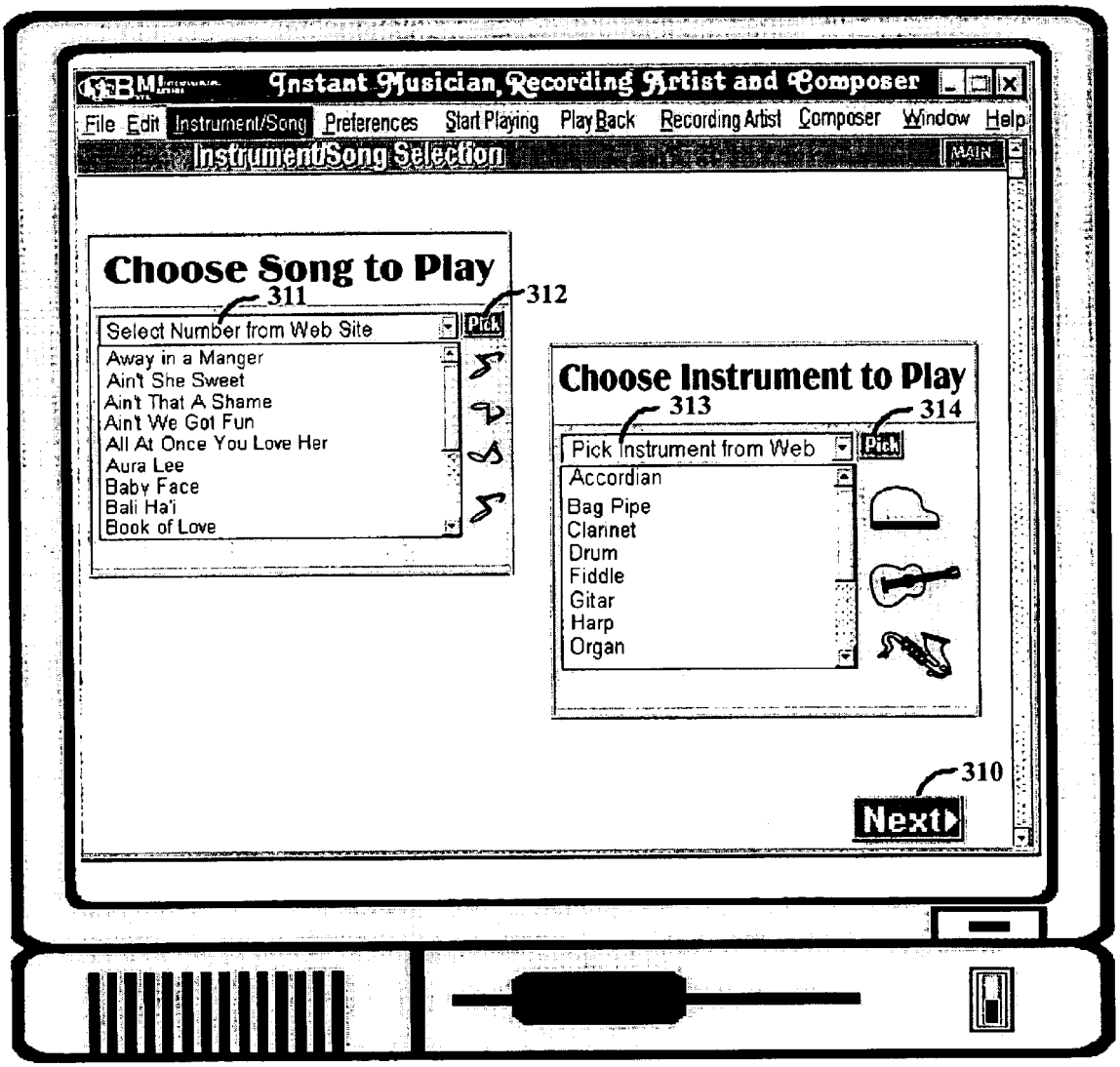
FIG. 4 shows one embodiment of musical instrument and song selection display where additional music numbers and musical instruments can be downloaded from the inventor's Internet site(s)

As indicated in FIG. 4, one option that appears in the selection area for selecting a song to play is "Select Number from Web Site" (311). Actuating "Pick" (312) then with a mouse or pointing device then initiates a connection to a Web site of the inventor where additional music numbers or songs are available either free or for a fee beyond those initially available by installing the Instant Musician, Recording Artist and Composer software. Similarly, by choosing to "Pick" (314) an Instrument from the Web" (313), sounds corresponding to additional musical instruments may be selected by the user, either free or for a fee, beyond those initially available when the Instant Musician, Recording Artist and Composer system software was installed.

Figure 5:
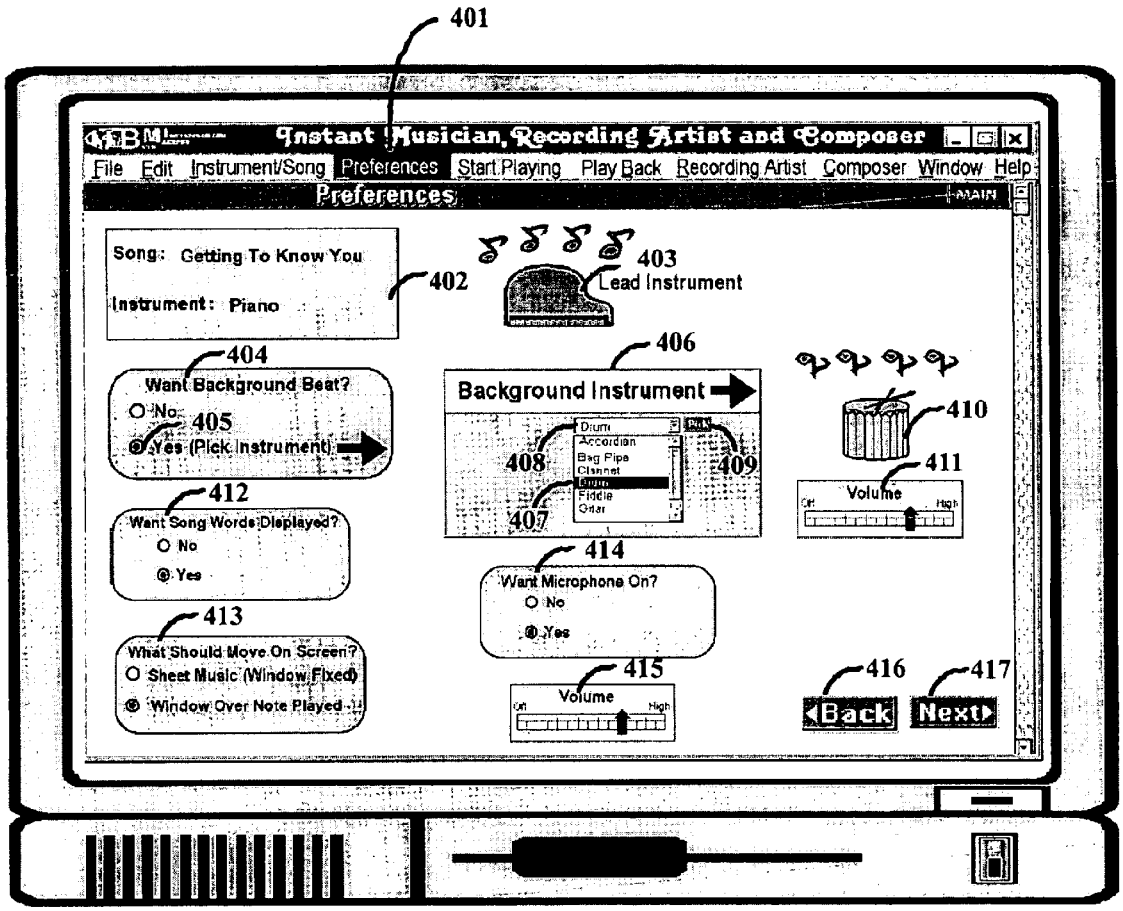
FIG. 5 shows one embodiment of a "Preferences" display where the user may select various preferences applicable to the "Instant Musician" aspect of the present invention.

Exiting the Instrument/Song selection display in the present embodiment is accomplished either by choosing another item from the main menu bar (201 to 211) or by actuating the "Next" button (310) which switches the user to the "Preferences" display shown in FIG. 5.

User Preferences Embodiments

The "Preferences" display of the present embodiment is shown in FIG. 5. The Preferences display may be reached at any time the system is operating by selecting "Preferences" from the main menu bar (401). While holding the Preferences item down with a mouse or pointing device exposes a longer list of preference items that can be selected at any time, and the display in the present embodiment includes several principal preferences in the form of labeled boxes with yes or no options (404, 412, 413 & 414). For the convenience of the user, the musical instrument selected and the song or musical number selected from the Instrument/Song display (FIG. 3) are shown on the Preferences display (402). In the present embodiment, a graphic depiction of the lead instrument selected is also shown (403).

The present embodiment of the invention includes the capability of the user to choose whether they wish a background instrument beat (404) to accompany the users playing or automatic playing. This background beat generates "beat" sounds in accordance with the time signature of the chosen musical piece (¾ time, 4/4 time, etc.) and various user preferences selected pertaining to the background instrument beating and rhythms. If "yes" is selected relative to the presence of a background instrument beat (405), a box opens on the display (406) permitting the user to select the instrument (407) that provides the background beat. Once the background instrument has been selected from the list and entered into the selection area (408), actuating the pick control button (409) designates the selected instrument for the background beat sound. After a background instrument has been selected, a depiction of the background instrument also appears on the Preferences display (410) as well as a means to adjust its volume (411) relative to the lead instrument (403).

The present embodiment of the invention also includes a box area on the Preferences display to choose whether or not the user wishes a chosen song's word to be displayed (412) along with a display of the music score and keyboard letters to type. Choosing "Yes" accomplishes this effect. Additionally, the user has an option governing what manner the displayed music score moves on the display (413). Options on what moves on the display for the present embodiment of the invention are: 1) music score moves (right to left as the music is played), or 2) a current note window moves over the displayed music score from left to right as music is played. The window referred to in this embodiment of the invention is depicted (502) in the "Start Playing" display (FIG. 6).

Another user option on the Preference display is whether it is desired to have the system pick up sounds from the computer's microphone or sound pick up device (414) and what the relative volume of this microphone or sound pick up device should be (415) relative to the lead instrument sound to be generated and the background instrument volume (411).

In the present embodiment, actuating the "Back" control button (416) with a mouse or other pointing device returns the user to the Instrument/Song display (FIG. 3) whereas actuating the "Next" control button (417) brings up the "Start Playing" display (FIG. 6).

Instant Musician Embodiment

A display for the "Instant Musician" aspect of the preferred embodiment of the present invention is shown in FIG. 6. This display may be accessed via the "Start Playing" entry on the main menu bar (501) or by clicking on or selecting the "Next" control (417) of the "Preferences" display (FIG. 5).

As indicated in the "User Plays or Automatic" control box (503), there are two ways a user may play the chosen song or music number with the chosen instrument sound. These options include: 1) user plays instrument, and 2) automatic playing. Independent of which mode the user selects for playing the selected song or music number and lead instrument, the display shown in FIG. 6 will remain basically the same with only minor variations in the preferred embodiment.

In the "User Plays Instrument" mode of operation, the user has several ways of creating the sounds of the selected instrument. In the default mode, the user simply types the letters on the computer keyboard that are shown in the present note to type window (502). Alternatively, the user may use a mouse or other pointing device to point and click (or designate) the key or particular part of the selected musical instrument that is shaded (504), or the user may point and click right on the note shown in the music score (505). The shaded part of the indicated instrument (504) is the item on that instrument that is required to be activated by the user to produce the note shown in the current note window. In the example shown in FIG. 6, a piano keyboard is shown (506) with the particular piano key shaded (504) that corresponds to the current note to be played.

Figure 7:
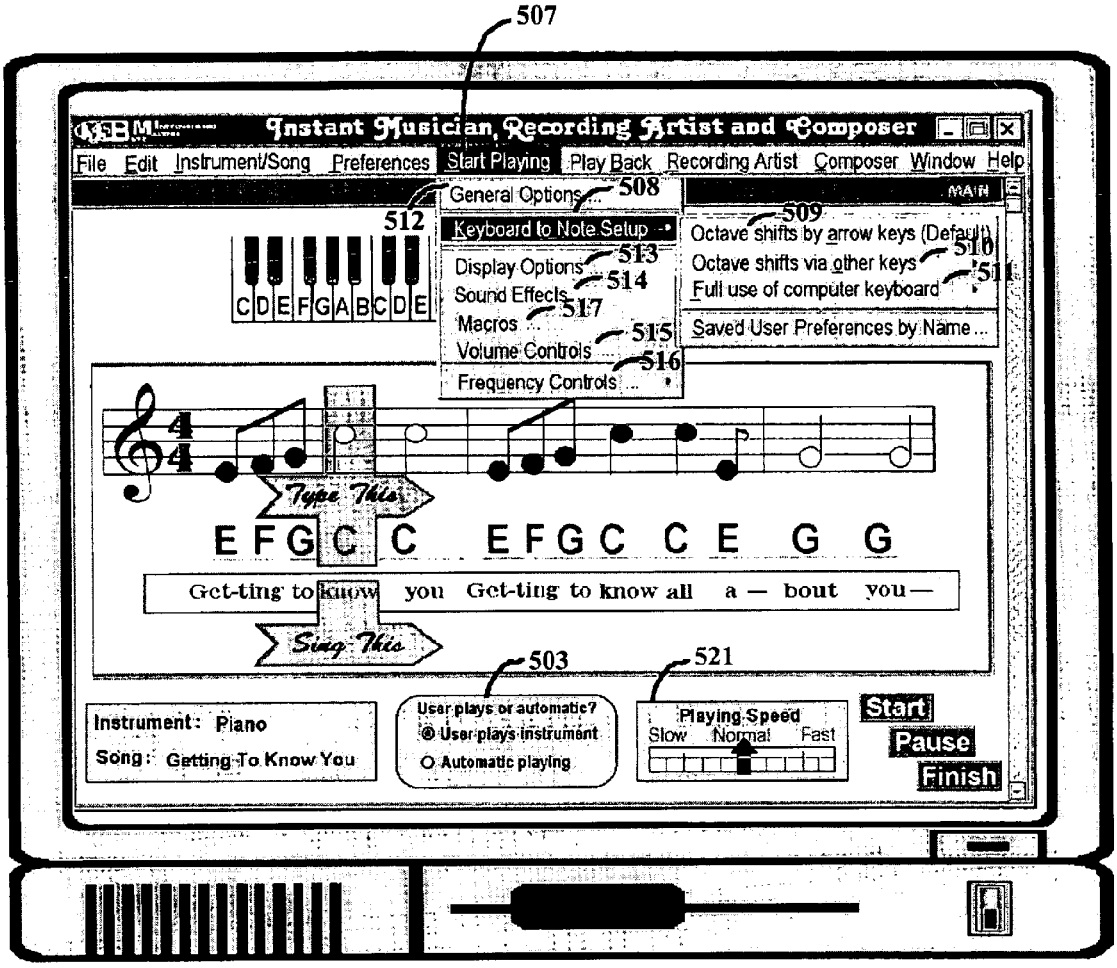
FIG. 7 shows one embodiment of the "Start Playing" display with menus and sub-menus available for user setup and preferences.

In the preferred embodiment, alternative means are offered for shifting octaves and other playing options as may be seen in FIG. 7 where the "Start Playing" menu items are shown (507). Also shown in FIG. 7 is a sub-menu of the Start Playing main menu (Keyboard to Note Setup) (508). It may be noted that in the preferred embodiment that the default method of shifting octaves for a key typed on a standard computer keyboard is to use the up or down arrow keys (509). That is, the default method for shifting octaves and still being able to type the same key that corresponds to the actual music note designation, say a "C," is to use an up or down arrow key prior to or at the same time as typing the "C" key. Other options offered for shifting octaves include use of function keys, shift keys, numeric keys or control keys and these may be selected via use of the "Octave shifts via other keys" menu item (510). Another option offered via the "Keyboard to Note Setup" menu item (508) is to access different octaves, sharps and flats and other musical note variations via "Full use of computer keyboard" (511). This option makes use of keys, such as the "q" keyboard key for an "A flat" key, use of the "w" key for an "A sharp" key, etc. Other options involve specifying what keyboard keys and their manipulation are used for playing fortes, mezzo fortes legatos and tied notes (512). Other options shown on the Start Playing menu include "Display Options" (513) for altering what is shown, or not shown, on the Instant Musician "Start Playing" display, a menu item for imposing special sound effects during the playing (514), volume controls (515), and controls for regulating the frequency range of the music number to be produced (516). Additionally, there is a menu item to initiate the recording of a music macro, or for the playing of a macro that creates a previously recorded music beats or rhythms (517).

Figure 8:
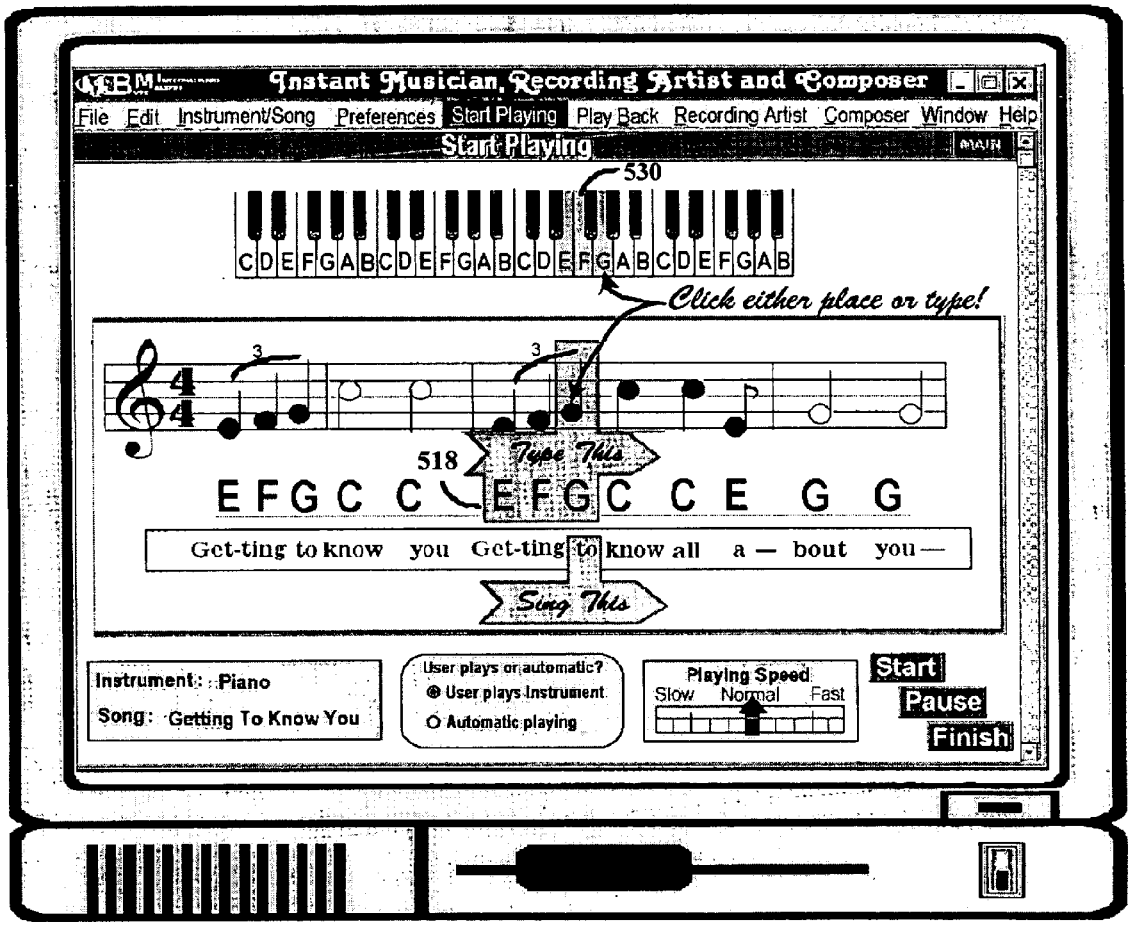
FIG. 8 shows one embodiment of the "Start Playing" display showing the representation for playing tied musical notes.

FIG. 8 shows a preferred embodiment for standard computer keyboard playing of tied notes. That is, tied notes meaning the playing of one note and playing another while still playing the first, or while still playing the last couple of notes. A preferred manner to point out the playing of tied notes on the computer keyboard is to have the display window area illustrating the note(s) to type become wide to the extent that it encapsulates each of the keys that must be held down (518). Other options may be selected from user preferences offered. In FIG. 8, the window area that illustrates the note(s) to be typed is shown at the last stage of a three note tied sequence of having the musical notes of E, F and G tied together after the playing of first E, then playing F which still playing E and finally the playing of G which still playing E and F.

FIG. 6 shows the words of a song (519), if they were selected to be shown (412), and the sliding window of the immediate part of the song or music number that is to be acted upon also has a portion that guides over the particular song's word(s) that correspond to the music note(s) being played (520). This allows the user to sing the song, if desired, either with playing or without playing (automatic playing) the music notes displayed and/or with or without recording the voice or other sound input.

Shown also in FIG. 6 is a control for adjusting the playing speed (521) at which the music score is moved or speed at which the note playing window (502) moves over the music score on the display. Preferences may be set, however, so having the note playing window (502) moving speed or the music score moving speed be solely dictated by the speed at which the user "plays" the music by typing, clicking or singing. The process of "playing music" begins when the user actuates the "start" control (523), and the process may be paused by actuating the "Pause" control (530), or the process of playing may be terminated at any time by actuating the "Finish" control (522).

Figure 9:
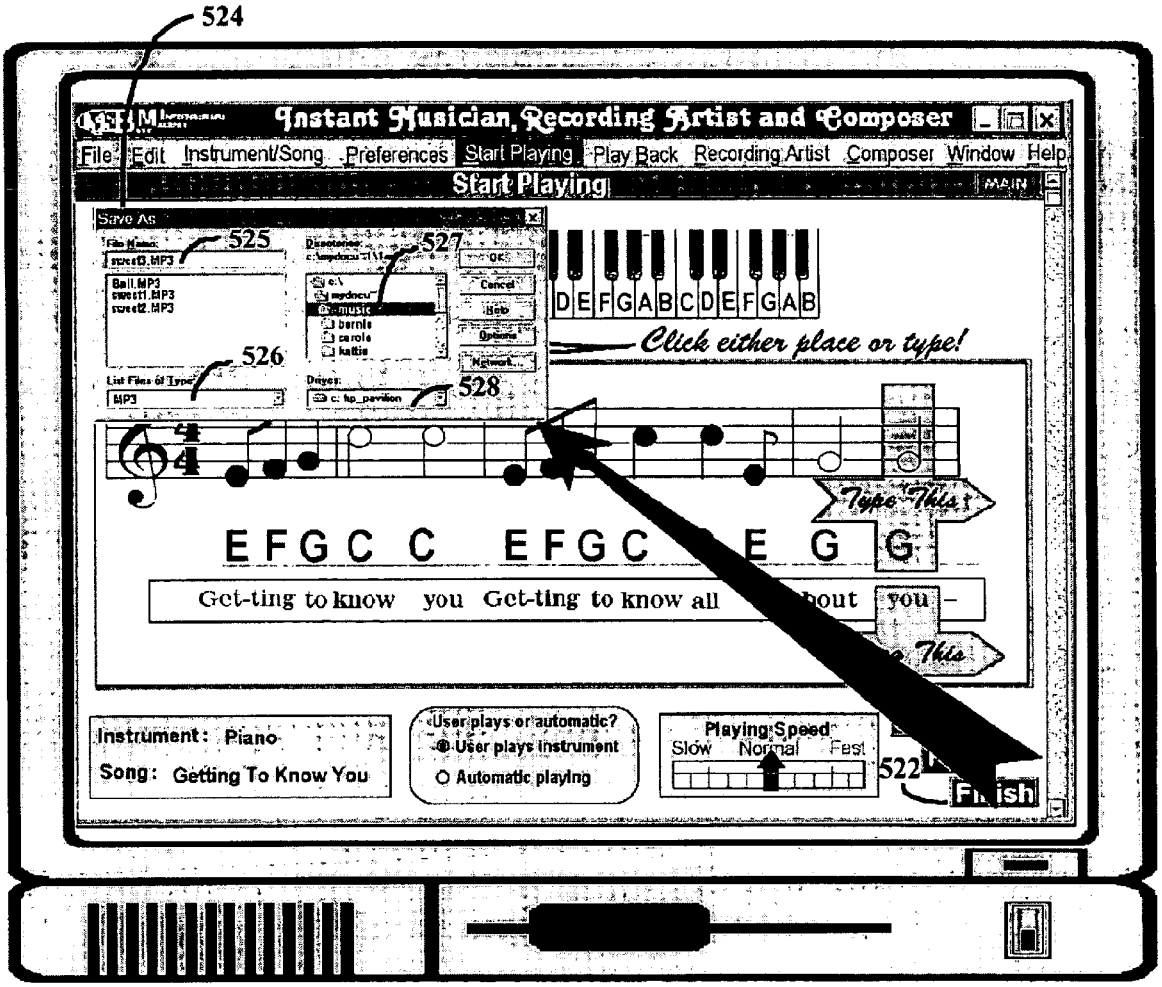
FIG. 9 shows one embodiment of a display presented to users for saving computer files containing musical sounds that they generated using the "Instant Musician" aspect of the present invention.

As indicated in the "User Plays or Automatic" control box (503), the system user elects to have the chosen song or music number either played automatically with the chosen instrument sound or manually. Whether the music piece is played manually or automatically, the music sounds created may be saved for later listening and/or combined with other saved music creations performed by the user or created automatically. When a user is finished manually playing a music number, or finished singing a musical number or a music number is finished playing automatically, the user may elect to save the music number by actuating the "Finish" control (522) shown in FIG. 6 which promptly brings up the file saving box (524) shown in FIG. 9. As shown, music file formats may be selected (526) for saving musical files generated including as a minimum MP3, MID and WAV file formats. The file to be saved may be given a name (525), placed in a computer directory of choice (527) and placed on different memory storage devices, such as the computer "C" hard drive (528) shown in the example. The played music files may also be saved on removable storage devices, such as CD-R/RW or CD-RW disks.

Figure 10:
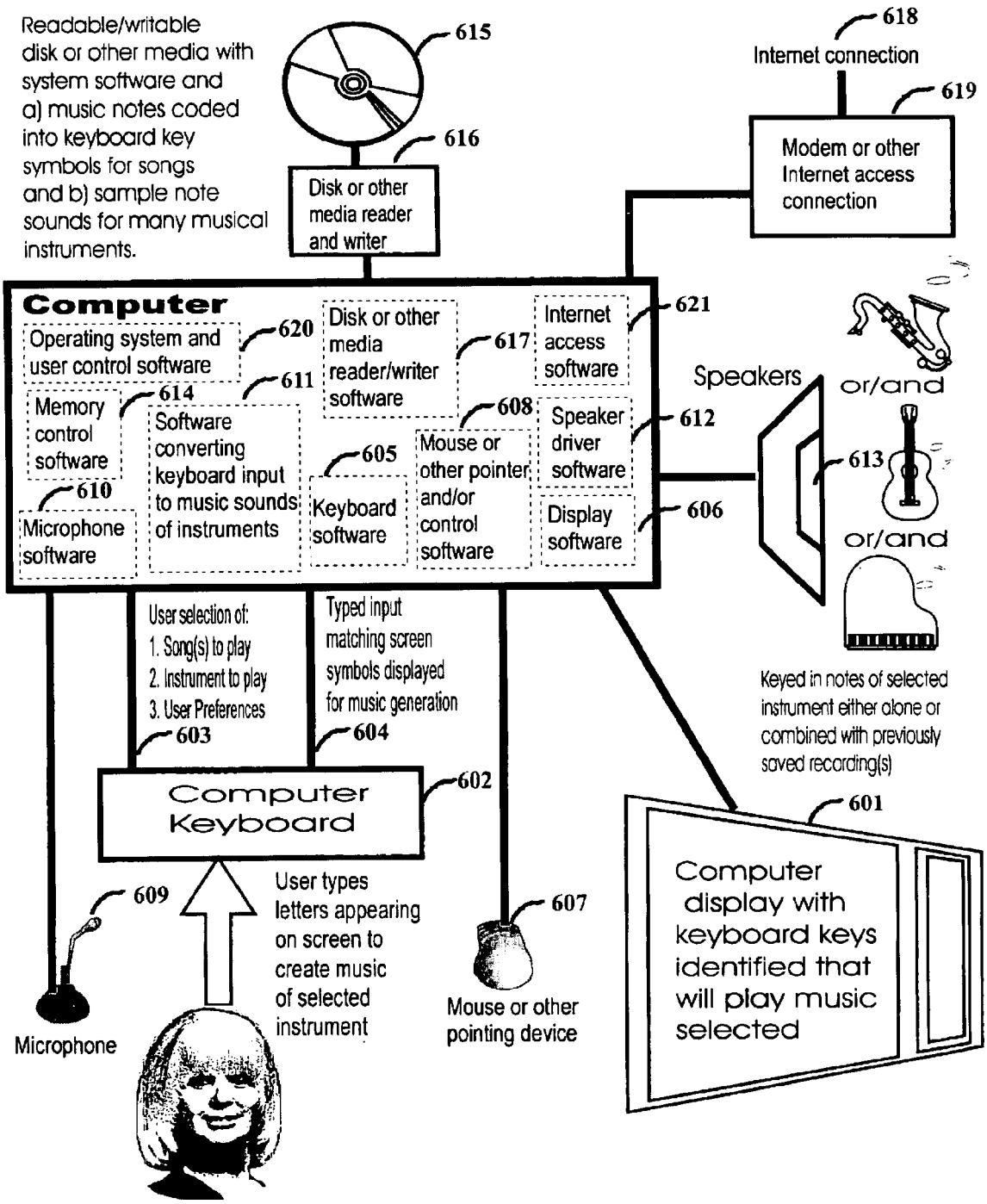
FIG. 10 is a block diagram showing a general hardware and software composition of the "Instant Musician" embodiment of the present invention.

A diagram of the Instant Musician general system structure showing how a user may generate music notes of any selected instrument is shown in FIG. 10. The computer display (601) via standard computer display software (606), shows the sequence of computer keyboard (602) keys to be depressed by the user to create the music notes corresponding to the music number the user had selected (603). The user types (604) the computer keyboard keys shown on the display (601) and these keyboard inputs are accepted via standard keyboard software (605). Alternatively, a user may use a standard computer mouse (607) or other pointing device via standard mouse or other pointing device software (608) to create musical sounds by "actuating" musical notes depicted in the music score on the display (601) or by "actuating" a spot designated on the musical instrument that had been previously selected (603). The term "actuated" here means the two-step process of pointing and clicking a mouse, or actions with any other pointing that accomplish the same computer input. The correct sound corresponding to the keyboard note typed or place actuated on the display by the pointing device is created with software (611) that matches the inputted keyboard note to the corresponding stored musical note sound of the particular note typed or otherwise inputted for the particular musical instrument that had been selected (603). A sound corresponding to the note inputted via the keyboard is created by the note conversion software (611) communicating with standard computer speaker software (612) that actuates the computer's speakers (613) or headsets. The computer's memory control software (614) manages the storage of musical note samples of the instrument selected for playing with the screen display and pointing device along with the specialized musical score display system corresponding to the selected musical number. The computer's memory managed for this purpose includes all volatile and non-volatile memory including RAM and the computer's hard drive. The computer obtains the specialized music scores and musical note samples of selected instruments from CD-ROM, CD-R/RW, CD-RW, ZIP or other portable media readers and recorders (615) via an appropriate reader/writer of the particular device (616) and a software reader/writer routine that communicates with that reader/writer device (617). Alternatively, data on specialized musical scores and musical note samples may be obtained from the Internet (618) via a standard computer modem (619) and Internet access software (621). All aforementioned software operates under control of common computer operating systems (620), such as Windows or other common operating systems.

In accordance with another aspect of the present invention, the user may elect to sing, or use some instrument, to generate sounds into a computer microphone (609) and have these sounds entered into the computer's memory via standard computer microphone software (610).

Figure 11:
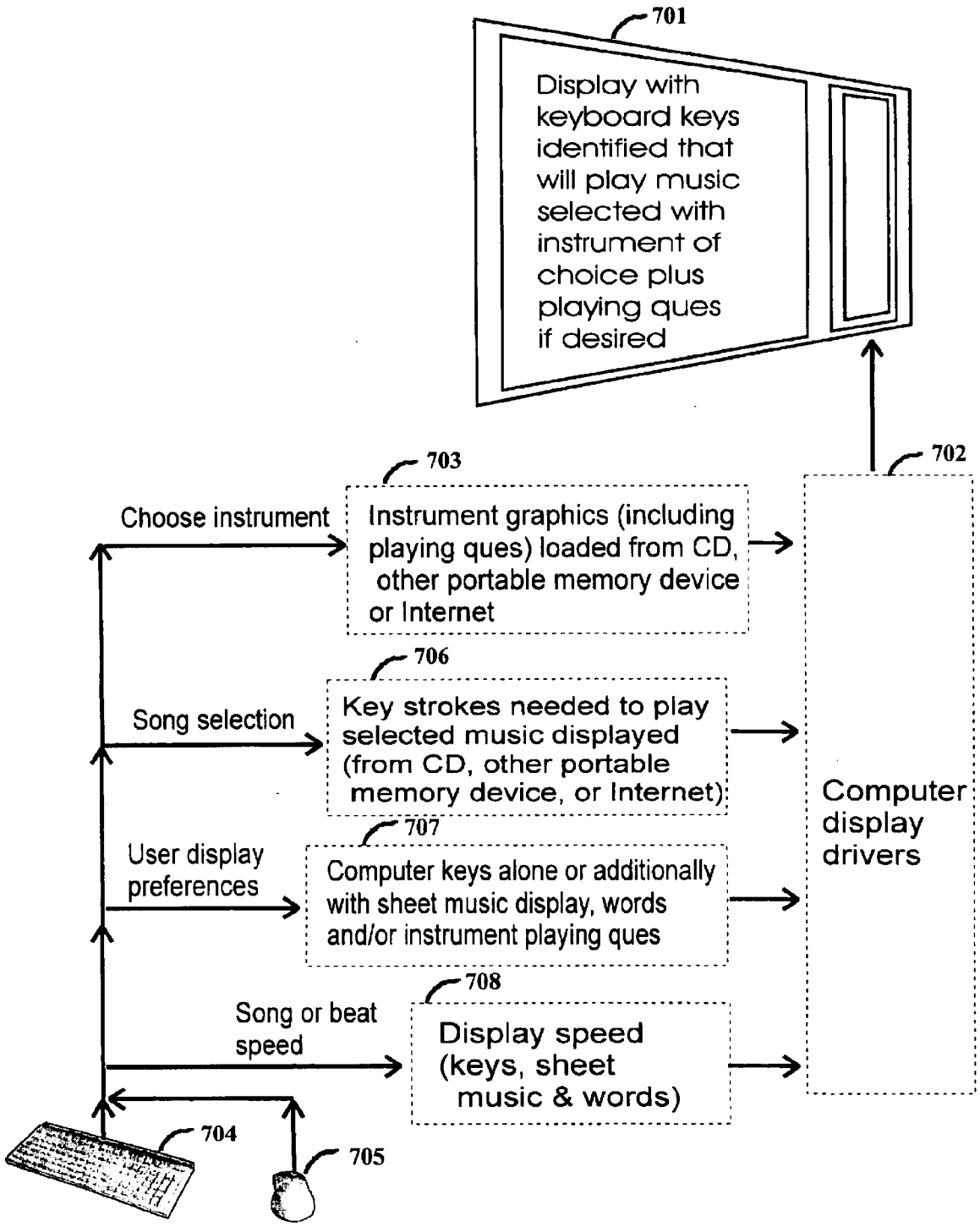
FIG. 11 is a block diagram showing a general hardware and software composition of the apparatus in the "Instant Musician" embodiment of the present invention for generating computer displays.

FIG. 11 illustrates major functional elements of the system that generates the Instant Musician displays (701) via standard computer display drivers (702). Software modules or software routines of the Instant Musician depict the selected musical instrument on the display (703) after the user chooses a musical instrument using a standard computer keyboard (704) or pointing device (705). Other software modules or software routines display music scores (706) along with the standard computer keyboard keys needed to generate the sounds of the selected musical instrument. Other software modules or software routines process user display preferences (707) including whether the user desired the music score displayed along with the computer keyboard keys need to play the selected music with the selected musical instrument sounds, or whether just the computer keyboard keys needed to play the music number should be displayed, or whether the music number should be played automatically using the instrument sounds of the selected instrument. Also, via the computer keyboard (704) or pointing device (705), the user may adjust the speed at which the display presents the computer keyboards keys to be typed to play the musical number and the speed at which the music score and music number or song words move on the display. This playing speed adjustment permits users with poor to moderate typing skills to generate musical numbers as well as users who can type the keyboard keys indicated to produce the desired sounds at the rate that would correspond to the rate at which a professional musician would play the notes presented on the selected instrument.

Figure 12:
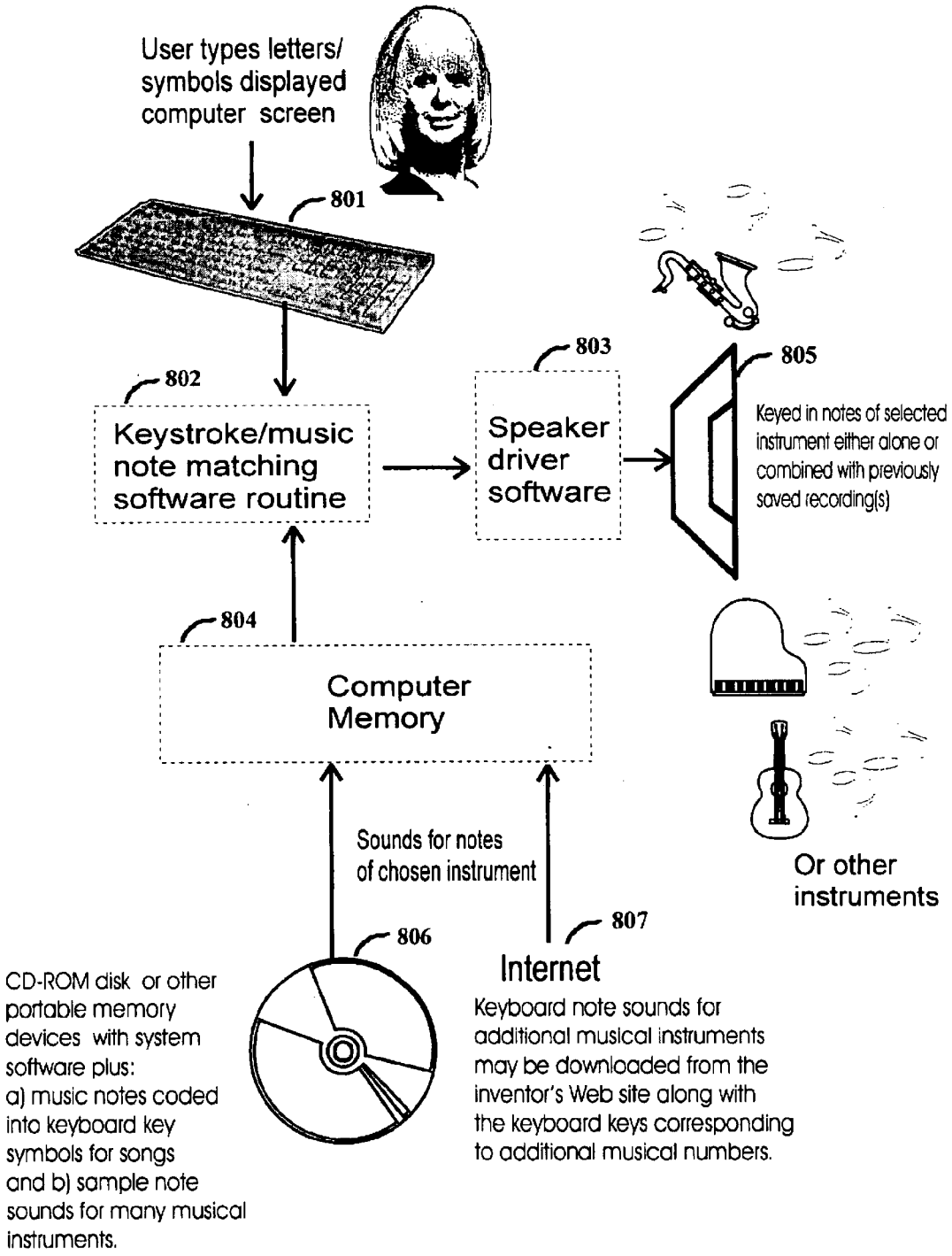
FIG. 12 is a block diagram showing a general hardware and software composition of the apparatus in the "Instant Musician" embodiment of the present invention that allows users to generate musical instrument sounds for selected music numbers by typing computer keyboard keys.

FIG. 12 illustrates how the sounds of the selected instrument are produced when the user types the computer keyboard keys (801). The keystroke/music matching software routine (802) matches the user's keystroke input to sample sounds from the selected musical instrument in the computer's memory (804) and sends the matched sound to the computer's speaker driver software (803) so the typed input is sounded on the computer's speakers (805) or the user's headset (speaker shown in example). The computer memory consists of both non-volatile and volatile memory managed by the computer's operating system (906). Sample sounds of the selected instrument are loaded into the computer's memory from a portable memory device (806) or downloaded from the Internet (807).

Figure 13:
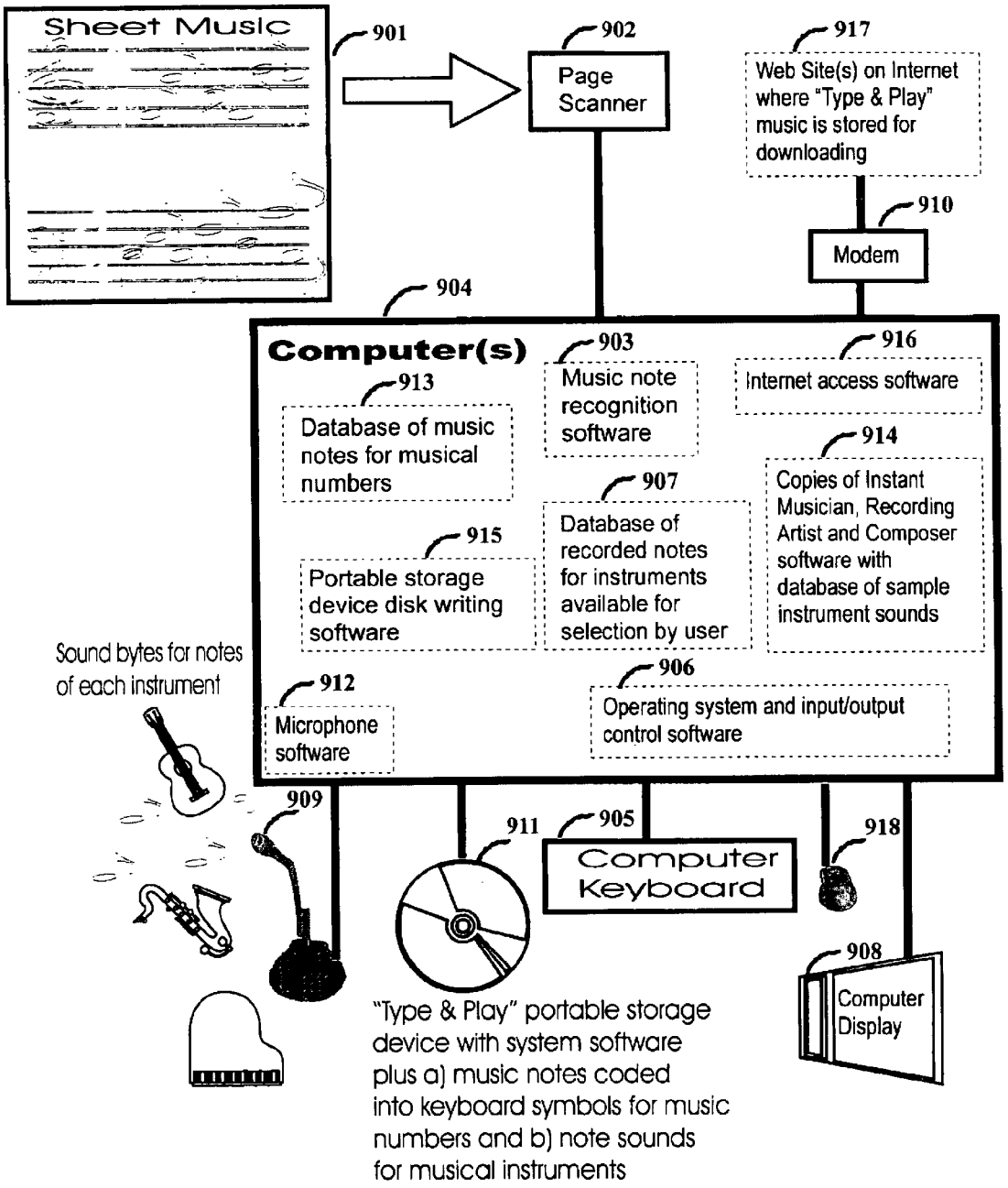
FIG. 13 is a block diagram showing a general hardware and software composition of one method of the apparatus in the "Instant Musician" embodiment of the present invention that creates portable storage devices containing music scores, instrument sounds and typing instructions for playing music.

FIG. 13 illustrates one embodiment for generating the portable storage devices that contain music notes coded to match computer keyboard keys for selected instruments. Sheet music (901) containing music scores may be scanned into a computer using a page scanner (902) and the scanned music score is then processed by music note recognition software (903) so that the music notes on the hard copy music score(s) may be identified by the computer (904) software and added to a database of musical notes for a number of different musical numbers (913). Alternatively, humans may input the observed notes on music scores (901) via a standard computer keyboard (905) also for the purpose of building the database of notes required for each music number (913).

The computer's operating system and input/output control system software (906) accepts inputs from either the page scanner (902) or human input of notes from the computer's keyboard (905) on the music scores and records them into a database of stored notes (913) for the particular music number processed. Still, in another embodiment of the current invention which is more related to the Instant Composer aspect of the system, musical notes may be generated from the processing of sounds picked up by a microphone (909). This allows musical notes to be generated for the musical number database automatically by simply playing previously composed music near the computer's microphone. The previously composed music may come from any source including: CDs, tapes, live playing, radio, television and the Internet.

Any common computer or computerized workstation operating system may be used for this purpose of generating the portable storage devices used to implement the combined Instant Musician, Recording Artist and Composer system on other computers as long as the computer or computerized workstation and operating system can operate with a standard computer keyboard (905), a computer display (908), a page scanner (902), a computer pointing device (918), a microphone or sound pickup device (909), modem connected to the Internet (910) and a device for generating portable memory devices, such as CD-RW, CD-R/RWs or CD-ROMs as shown in FIG. 13 (911).

Included in the Instant Musician, Recording Artist and Composer software database is a collection of recorded musical notes from a variety of musical instruments (907). The sample note sounds for the musical instrument database (907) are collected via a microphone (909) connected to the computer or workstation and its associated software (912). Alternatively, the sample note sounds may be collected via any portable memory storage device. These sample note sounds and portions of the databases for both the recorded instrument note samples (907) and music notes for musical numbers (913) are transferred to portable storage devices (911), like CD-ROMs, along with the Instant Musician, Recording Artist and Composer system software (914) for loading into user's computers.

Additionally, in one embodiment of the present invention, Internet access software (916) is used to upload portions of the databases for both the recorded instrument note samples (907) and music notes for musical numbers (913) via a modem (910) to the inventor's Web site (917), or other Web sites licensed by the inventor, for the purpose of providing additional music numbers and additional instrument sounds to users for a fee beyond those provided with copies of the Instant Musician, Recording Artist and Composer software (914).

Play Back Embodiment

All music numbers created either by typing keyboard letters displayed (502), by singing, humming or whistling via pickup from the computer's microphone or other sound pickup device (105) or automatically via the automatic playing mode (503), may be saved (524) by the computer user for later listening and/or modification. The user has a choice of specifying the name of the music file to be saved (525), the file type (526), the computer software directory (527) and the computer storage drives (528). In one embodiment of the present invention, musical files saved by the user or loaded into the user's computer by any other means, may be played back on the user's computer speakers (106) or headsets. This option for playing back a previously recorded music number is accessed via the "Play Back" entry on the main software menu item (206).

Figure 14:
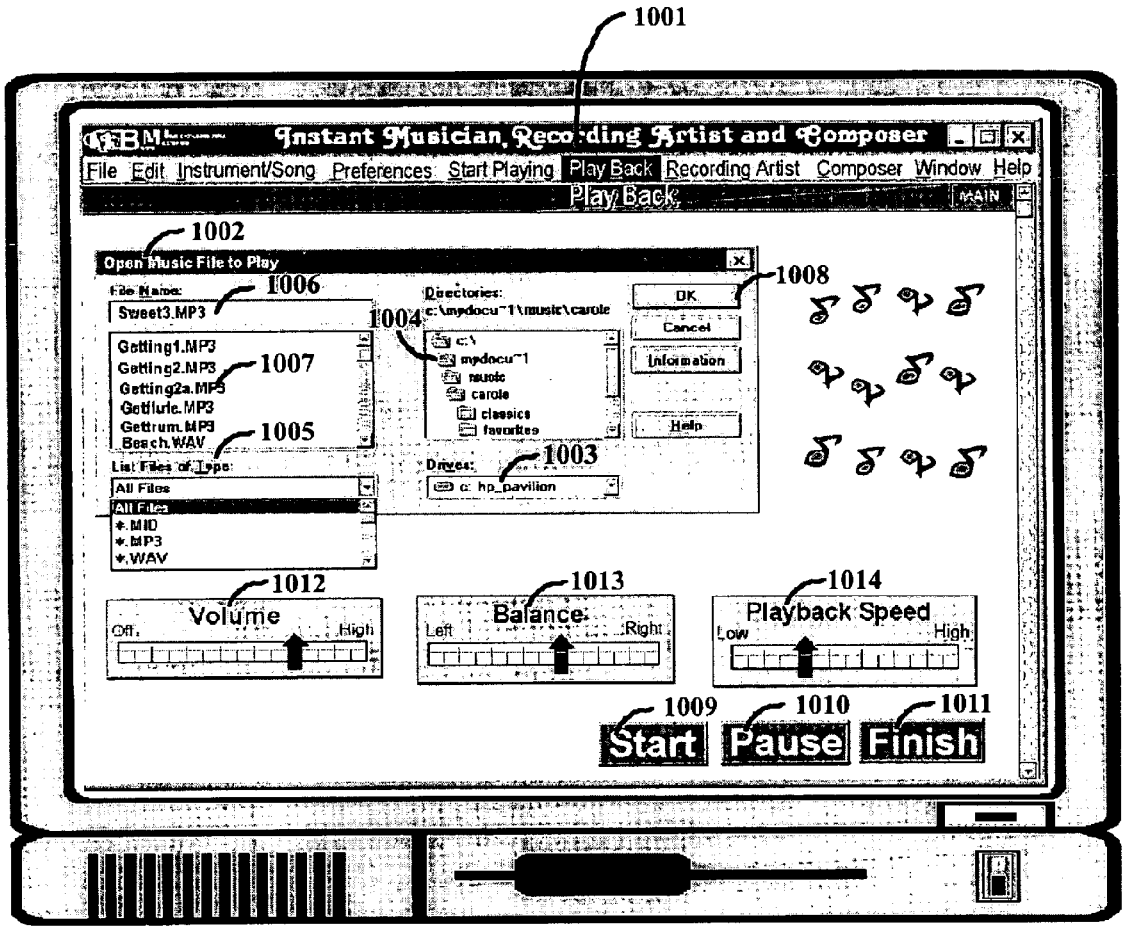
FIG. 14 shows one embodiment of the "Play Back" aspect of the present invention in which users may access files containing music they or someone else generated for the purpose of listening to the music.

FIG. 14 shows the display that appears when the Play Back menu item (1001) is selected by the user from the Instant Musician, Recording Artist and Composer main menu bar. In the "Open Music File to Play" window (1002) are guides to allow the user to control which music file is wished to be played back. These controls for retrieving files are in common use in many computer applications. They include selection of the particular computer drive (1003), selection of a computer directory (1004), type of file (1005), and the particular previously saved file wished to be retrieved (1006) from the list of saved files on the user's computer (1007) in the particular directory selected (1004).

After a particular music file has been selected (1006), clicking on "OK" (1008) confirms the selection of the particular music file to be played when the "Start" button (1009) is actuated. At any time, the play back of any file selected may be paused (1010) or finished (1011). Similar to most music playing apparatuses, there also is a volume control (1012) for adjusting the volume of the music played and balance control (1013) for shifting the relative sound volume from a right speaker (or earphone) to a left speaker (or earphone), or vice versa. Because the recorded music files contain digitized formats of the recorded music, an additional control is provided for speeding up or slowing down (1014) the rate at which the previously recorded music may be played back on the computer's speakers or headphones.

Instant Recording Artist Embodiment

Figure 15:
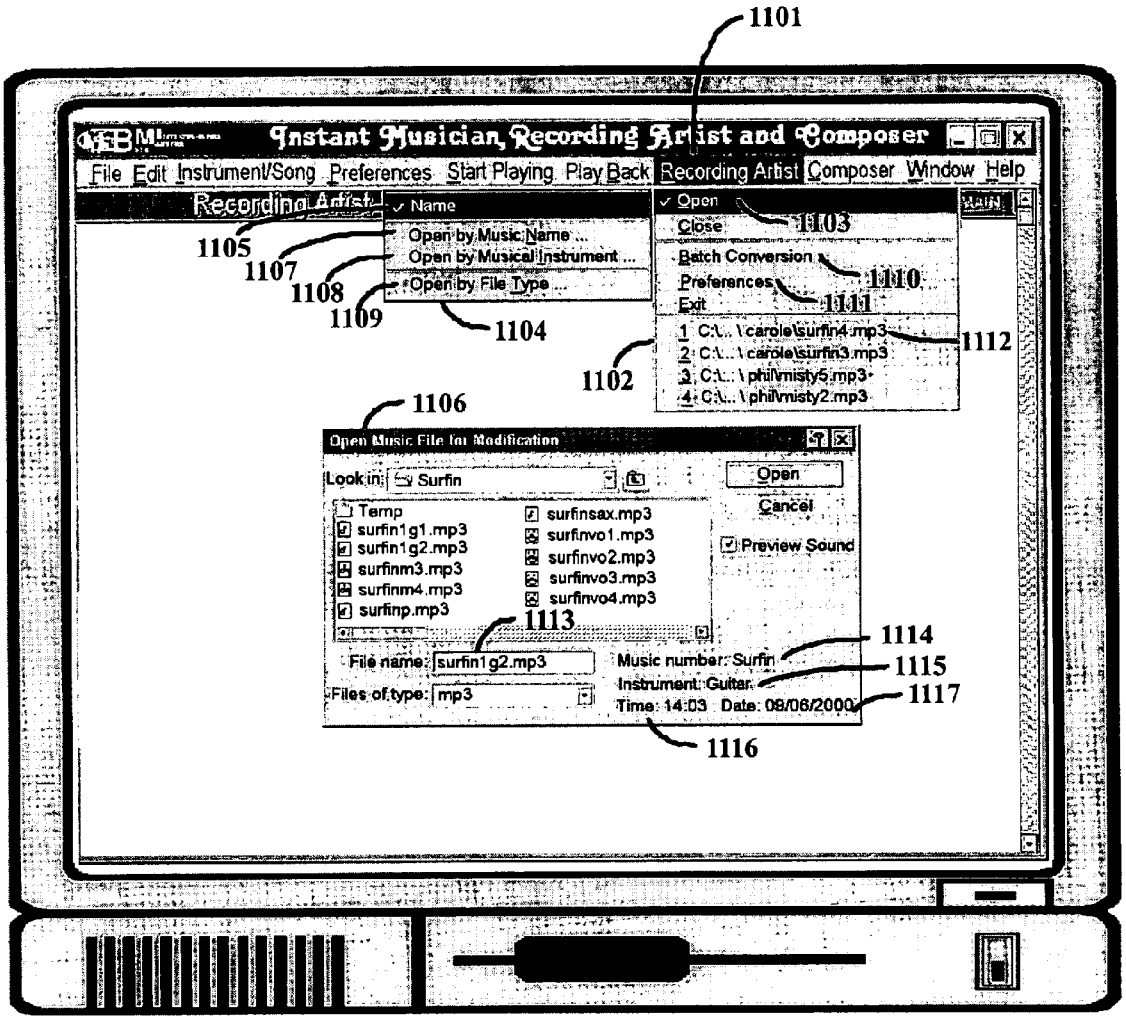
FIG. 15 shows one embodiment of the display for the "Instant Recording Artist" aspect of this invention display that aids users in accessing music files to be modified and/or combined.

FIG. 15 shows the display that appears when the Recording Artist menu item (1101) is selected by the user from the Instant Musician, Recording Artist and Composer main menu bar. This embodiment of the present invention allows user to combine and significantly modify previously recorded music files using both amplitude and frequency transformation processes.

Actuating the Recording Artist aspect of the system (1101) opens the Recording Artist main menu (1102) which offers sub-menus associated with retrieving files, manipulating music files and for selecting and setting user preferences. Selecting the "Open" menu item (1103) causes a sub-menu to open (1104), and selecting "File Name" (1105) brings up a dialog box (1106) where music files may be selected for both modification and combining. Upon selecting a tentative music file for opening in the file name box (1113), several information items pertaining to the file are listed including the music number (1114), instrument (1115), time (1116) and date (1117). Music files may also be selected for opening and subsequent modification by music number (1107), musical instrument (1108) or by file type (1109) (MP3, WAV, etc.). As noted on the main Recording Artist menu, there is a menu item that allows users to convert file types (1110) as well as a menu item to set and/or adjust user preferences (1111) affecting the operation of this aspect of the present invention. A list of the last files opened is also listed on the Recording Artist main menu (1112).

Figure 16:
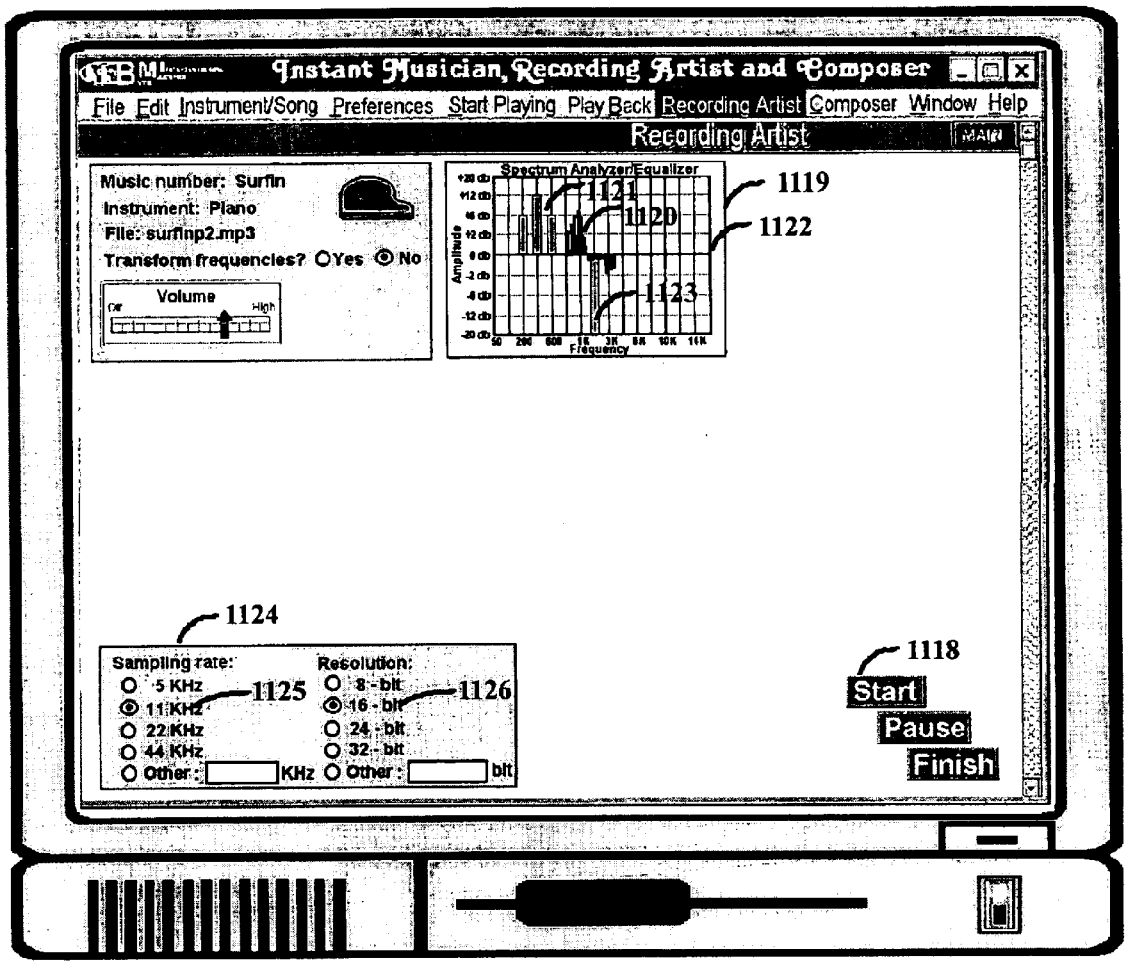
FIG. 16 shows an embodiment of the "Instant Recording Artist" display that includes an integrated frequency spectrum analyzer and imbedded equalizer for the purposes of attenuating or amplifying music in selected frequency bands.

FIG. 16 shows the Recording Artist display after a single music number has been selected and started to play after actuating the "Start" control (1118). The Spectrum Analyzer/Equalizer display (1119) is a combined display which shows both the instantaneous frequency spectrum (1120) of the music number being played plus the equalizer settings (1121) (1123) that adjust the music number sound amplitudes or loudness in the frequency ranges selected. In a preferred embodiment, the settings for the equalizer function are set by dragging the computer pointer or mouse up or down from the zero decibel (db) line (1122). In the example shown in FIG. 16, the user has set the equalizer in three places amplifying sounds in the vicinities of 200, 400 and 600 Hz up 6 db, 12 db and 6 db (1121), respectively, and attenuated sounds in the vicinity of 1.5 KHz down minus 20 db (1123). The settings on the equalizer may be changed at any time during the playing of a number.

Before the "Start" control (1118) is actuated in the Instant Recording Artist aspect of the present invention, a control box is present (1124) for the purposes of choosing a sampling rate (1125) and resolution (1126) of the music that is to be modified and saved via the Instant Recording Artist software.

Figure 17:
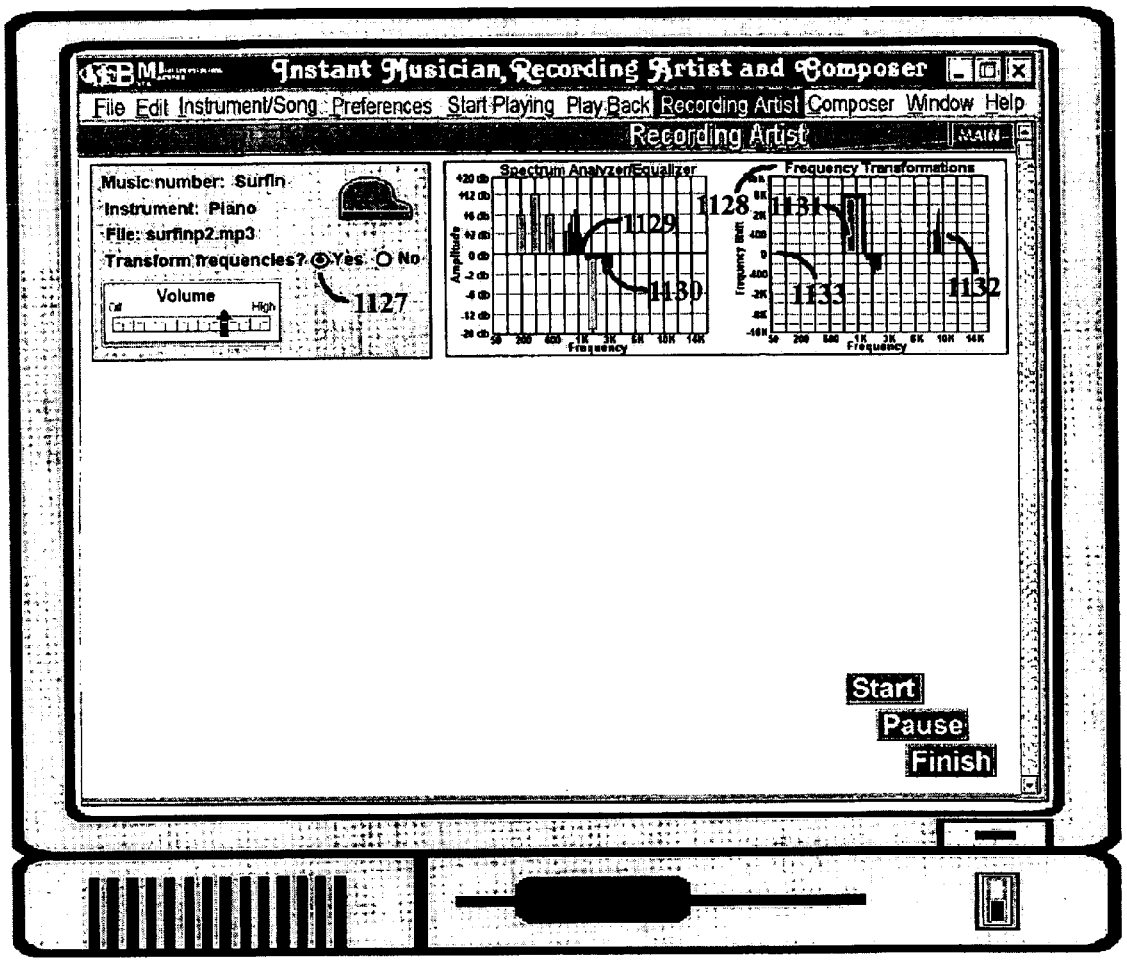
FIG. 17 shows an embodiment of the "Instant Recording Artist" display that includes an integrated frequency spectrum analyzer and imbedded equalizer plus a feature for transforming music in selected frequency bands into music sounds in completely different frequency bands.

FIG. 17 reveals an Instant Recording Artist display with the "Transform Frequencies" control chosen to be in the "Yes" (1127) category. Choosing this option causes the "Frequency Transformations" portion of the display to appear (1128) as shown in FIG. 17. In the present embodiment, an example is shown in FIG. 17 where there are two dominant frequency ranges where the music being played at the instant has sounds occurring. The sounds of the original music number are at approximately the 800 Hz to 1.5 KHz frequency range (1129) and in the 1.5 KHz to 4 KHz frequency range (1130). If the user elected to shift the frequency spectrum of the music being heard (or seen via the spectrum analyzer) in the 800 Hz to 1.5 KHz range (1129) up 8 KHz, the user would insert a positive frequency shift of 8 KHz into the 800 Hz to 1.5 KHz frequency range of the Frequency Transformation section of the display (1131). This action would result in the sounds in the 800 Hz to 1.5 KHz range (1129) being shifted into the approximately 8.8 KHz to 9.5 KHz range as shown (1132). The inputted frequency shift in the range indicated is accomplished by simply dragging the mouse or pointing device up or down from the zero frequency shift axis (1133) in the Frequency Transformation window (1128), and there is no limit on the number of frequency shifts entered as long as they are consistent with the resolution of the digital music being transformed. Conversely, if no frequency transformation was entered by dragging a mouse or pointing device, the Frequency Transformation widow simply would show the music frequency composition exactly as seen on the Spectrum Analyzer/Equalizer window.

The frequency transformations are accomplished by frequency transformation algorithms, or in the present embodiment, by multiplying an original music number frequency/amplitude sample vector, x, by a frequency weighting matrix, M, to result in the transformed frequency/amplitude vector y where y=Mx. The diagonal elements of the matrix M are controlled largely by the spectrum analyzer function while both the diagonal elements of the matrix M and its off diagonal elements are controlled by the inputted desired frequency spectrum shift(s). The number of elements in the vectors x and y and the size of the matrix M are controlled by the music number resolution chosen by the user (1126). Typically, the vectors x and y are the same size, but not necessarily, and the size of matrix M is determined by the product of the x vector size times the y vector size.

Figure 18:
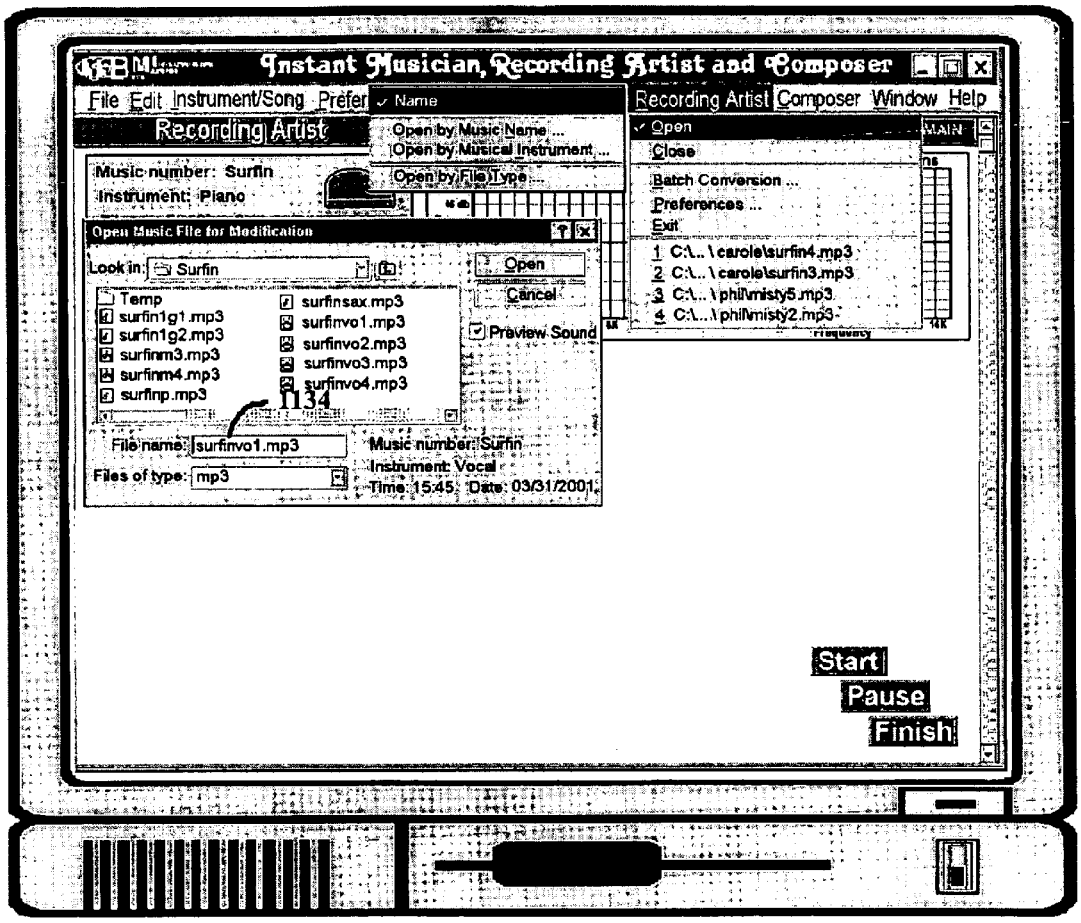
FIG. 18 shows an embodiment of the "Instant Recording Artist" display that allows additional music files to be accessed and opened so they may be combined with the initial music file opened for modification.
Figure 19:
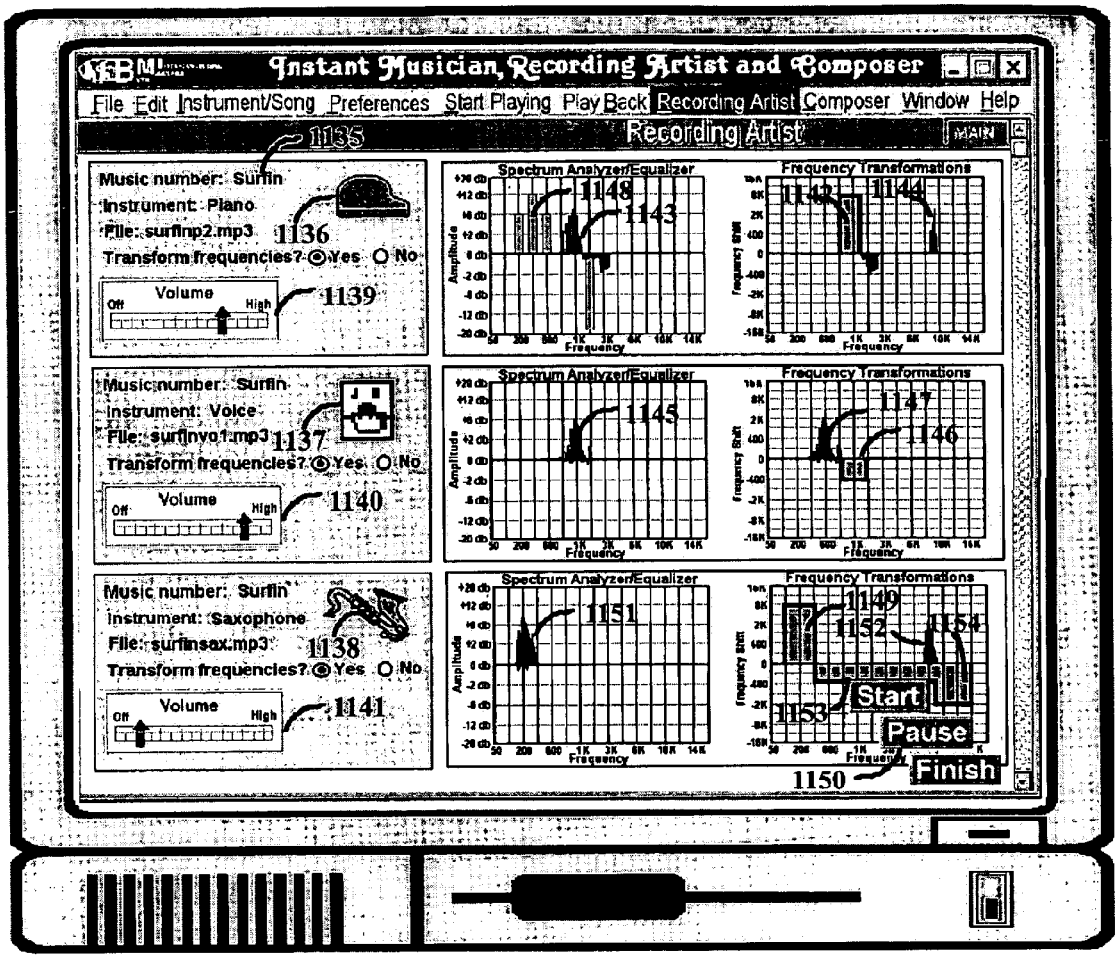
FIG. 19 shows an embodiment of the "Instant Recording Artist" display that includes the integrated frequency spectrum analyzers, imbedded equalizers, and frequency transformers for multiple music numbers that are being combined into a single music number with different relative volumes for each music file being transformed, equalized and combined.

As indicated in FIG. 18, additional music number files may be opened (1134) beyond the initial file opened (1113) including files containing music played with different instruments and/or different voice recordings. A Recording Artist session where the user has opened three music files for both modification and combining is shown in FIG. 19. The only limit imposed on the number of different music files that may be opened and combined at one time is the capability of the computer(s) hosting the Instant Musician, Recording Artist and Composer system software. One method which may be used to create a combined music number having the contributions of many instruments and/or voices is to combine a few music recordings together and then keep on adding additional instrument recordings and/or voice sessions to the original combined music number. Using this approach, there is no limit to the number of instruments and/or voices that may be contained in a single combined music number. As noted by symbols of musical instruments in the example shown in FIG. 19, the three files opened for combining with or without individual modification in the combining process include versions of the music number "Surfin" (1135) performed with a piano (1136), voice (1137) and saxophone (1138). As noted, there are separate volume controls for each music piece (1139, 1140, 1141) so the composite music piece file being generated and recorded may have different relative volume levels contributed from each music file being combined and these volume levels may be changed at any time.

For simplicity in describing the embodiments of the present invention, the settings for the volume control, equalizer and frequency transformation settings for the piano file (1136) music number are the same as those that were described in FIG. 17. These settings shifted the frequency spectrum of the piano music up by 8 KHz (1142) that was originally in the frequency range of 800 Hz to 1.5 KHz frequency range (1143) resulting in these sounds being expressed for the combined music number in the 8.8 KHz to 9.5 KHz range (1144). With the resulting shift, the piano notes in the original piano recording will sound significantly higher in frequency than originally recorded. Frequency shifts entered by the user in the example for frequency shifts in the voice recording (1137) transform the voice music in the vicinity of 1 KHz (1145) down 400 Hz (1146) resulting in the voice sound being shifted into a range near 600 Hz (1147). This shift phenomena may make a soprano voice sound like a baritone or bass singer. It may be noted that any of the equalizer controls (1148) or frequency transformation controls (1142, 1146, 1149) may be changed at any time during the playing of a single music number or during the playing of several instruments/voices, and that the combined or single music number may be paused at any time to make these changes by actuating the "Pause" control (1150).

FIG. 19 shows the last music piece in the screen window as being played by a saxophone (1138). However, if more music numbers were selected to be combined and modified at one time, the remaining music numbers could be accessed by scrolling down the window. While no use of the equalizer has been shown for the saxophone music number, as well as the voice recording, this particular music embellishment is well known in the industry. However, use of the frequency transformation function of the current invention is shown for the saxophone sound (1149) on original music (1151) to a range approximately 8 KHz higher (1152). Such a dramatic shift to higher frequencies would make the saxophone music sound like a completely different instrument like perhaps a flute or even sound like a newly invented instrument never before heard. Also to be noted in the saxophone music number frequency transformation space is a large section of frequency downshifts ranging from minus 400 Hz (1153) to minus 2 KHz (1154). However, since there was no original music sounds occurring in the frequency ranges selected at the time (400 Hz to 14 KHz), there was no action that occurred for this particular frequency transformation input by the user. But, as the selected music number plays on, there very well may be original music notes in those selected frequency ranges which would then result in the frequency shifts inputted for those ranges.

Figure 20:
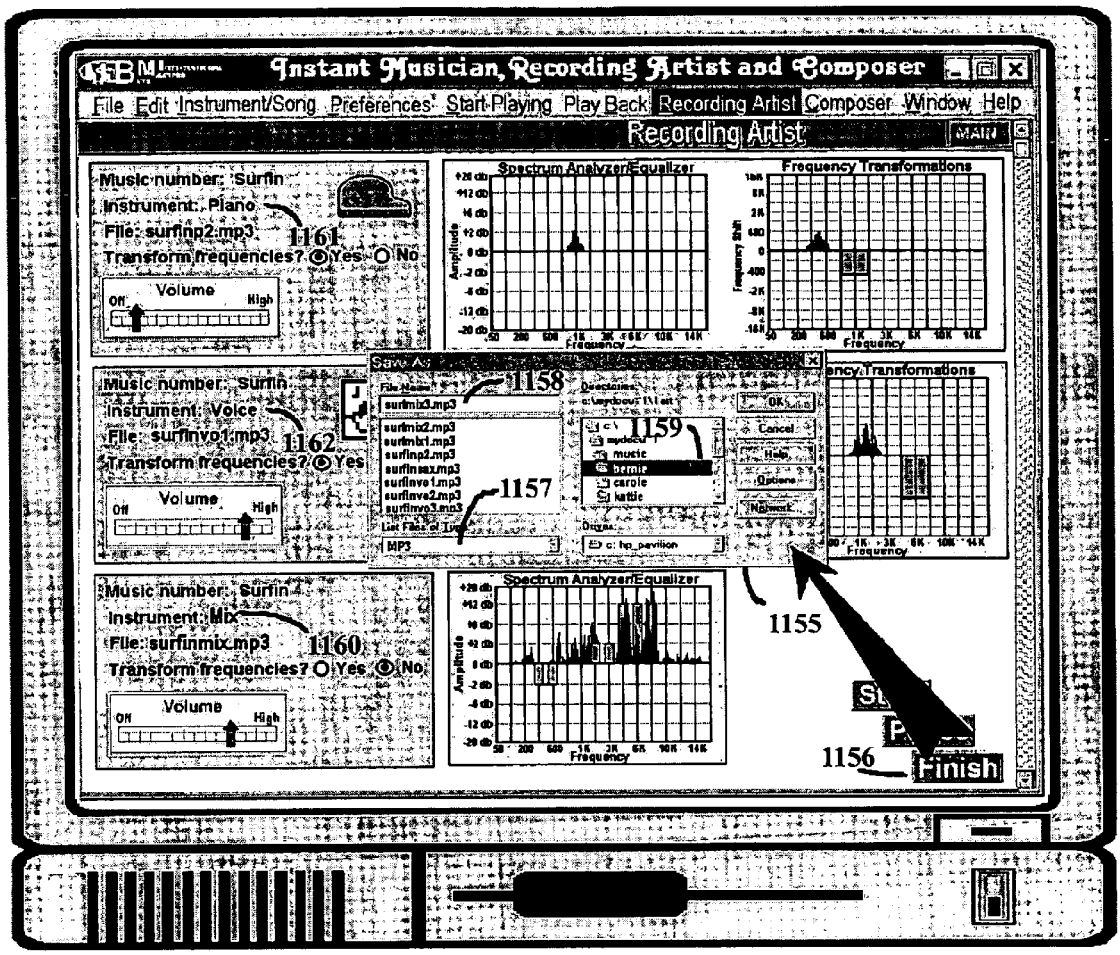
FIG. 20 shows one embodiment of a display in the "Instant Recording Artist" aspect of the present invention that allows users to save musical files generated using this aspect of the present invention.

FIG. 20 shows the control window (1155) that appears when the "Finish" (1156) control of the Recording Artist is actuated. Options for saving the file in a format are provided (1157) as well as a file name (1158) and computer directory (1159). Shown in the lower section of the display shown in FIG. 20 is a file from a mix of instruments or voices (1160) that is being combined, or has been combined, with music numbers previously recorded using piano sounds (1161) and voice sounds (1162).

Key elements of the Recording Artist embodiment of the present invention are depicted in FIG. 21. Memory control software (1201) handles the selection of music numbers to be combined and/or modified from user selection and preference inputs via a standard computer keyboard (1202) and/or mouse or pointing device (1203). The input commands for these devices are supported by standard keyboard software (1204) and standard mouse or other pointing device software (1205). Used in the present invention are also standard computer speakers (1206), standard software supporting speakers (1207), a standard computer display (1208), standard display software (1209), removable disk or other portable storage device (1210) readers/writers (1211), software for reading and writing to these storage devices (1212) and a common computer operating system and other user input/out control software associated with the operating system (1213).

While not a feature in itself that is unique to this patent, there is the spectrum analyzer and equalizer embodiment (1214) that augments the unique features of this patent. A unique feature of the Recording Artist aspect of this patent is the frequency transformation software (1215) which transforms inputted music frequencies in accordance with user input of the music frequencies to be transformed (1216). Included in the software comprising the Recording Artist is the routine for combining the music numbers (1217) in accordance with volume settings selected by the user.

Instant Composer Embodiment

Figure 22:
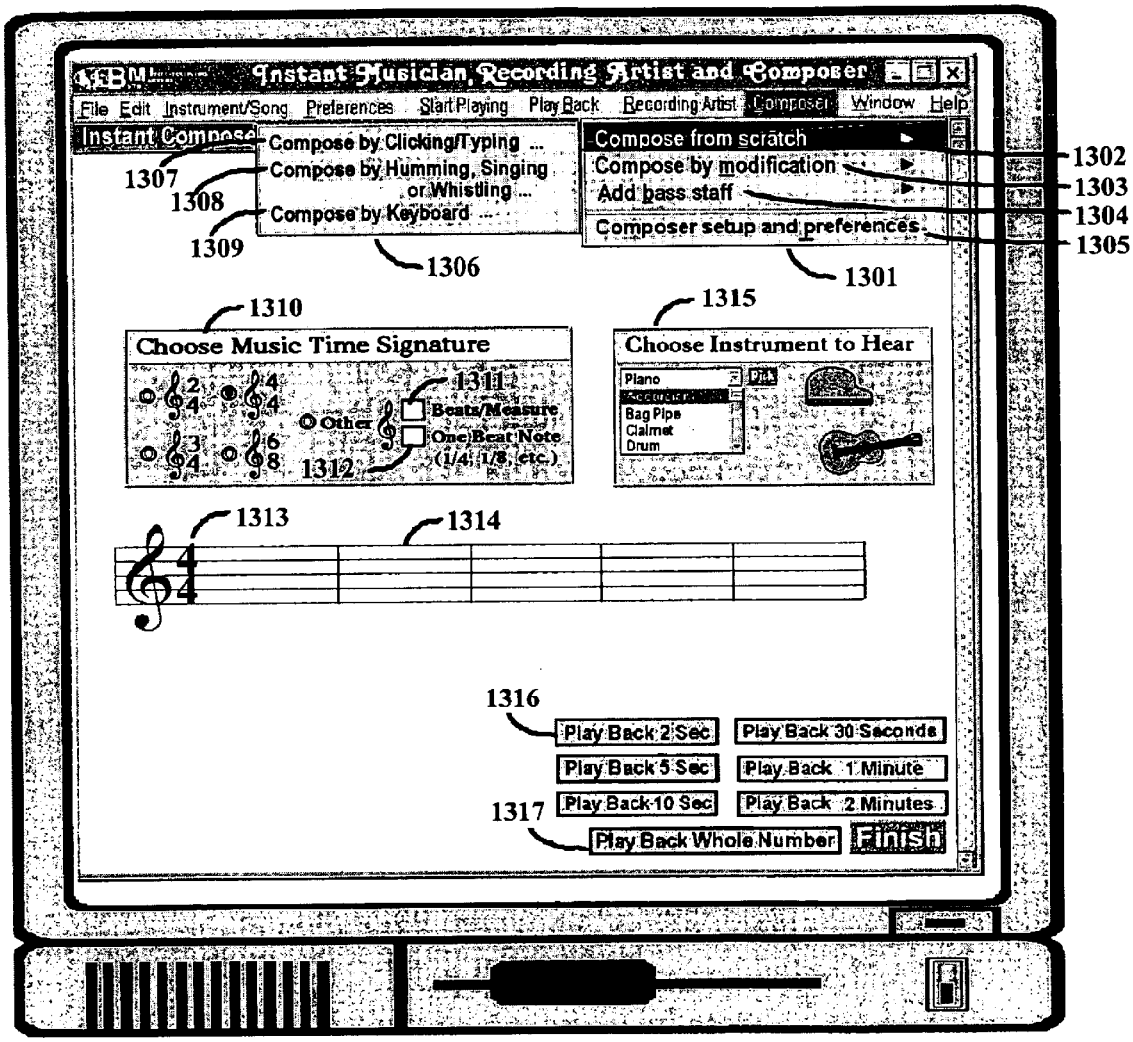
FIG. 22 shows one embodiment of an "Instant Composer" display which allows users to choose among various options for composing their own music.

FIG. 22 shows a preferred embodiment of the main display of the Instant Composer function of the present invention. Shown on the main menu (1301) of the Instant Composer is a selection of two different ways in which music numbers may be composed including Compose from Scratch (1302) and Compose by Modification (1303) plus menu selections allowing users to add bass music staffs (1304) or bass notes to their music scores previously composed as well as a main menu item allowing users to set preferences (1305) governing how various operational features of the Instant Composer are implemented. Alternatives for composing music from scratch are shown on a submenu (1306) and these alternatives include: composing by clicking a mouse or other pointing device or typing (1307), composing by humming, singing or whistling (1308), and composing by Keyboard (1309). The keyboard composing mode referred to here is not composing via a keyboard related to conventional musical instruments, but rather composing via a standard computer keyboard.

The initial display for the Instant Composer feature of the present invention (FIG. 22) allows the user wishing to compose a new music number to select the time signature for the new music (1310). Choices are offered for common music time signatures (2/4, 3/4, 4/4, 6/8) as well allowing the user to input a new time signature for both beats per measure (1311) plus the type of note that will receive one beat (1/4 note, 1/8 note, etc.) (1312). The default music time signature is 4/4 or four beats per measure with one quarter notes receiving one beat. This music time signature is shown on a music score (1313) that remains blank (1314) until the user begins composing via the method selected. A final choice of options before proceeding on with composing is to choose an instrument to play the music (1315) to be composed as the composing procedure begins. Sounds from the instrument selected occur as notes are added to the music score as well as when the user elects to have recent composed segments of the newly composed music played back. In a preferred embodiment, play back time periods range from the last two seconds (1316) composed to playing back every piece of the music composed from the beginning to the last note entered (1317).

Figure 23:
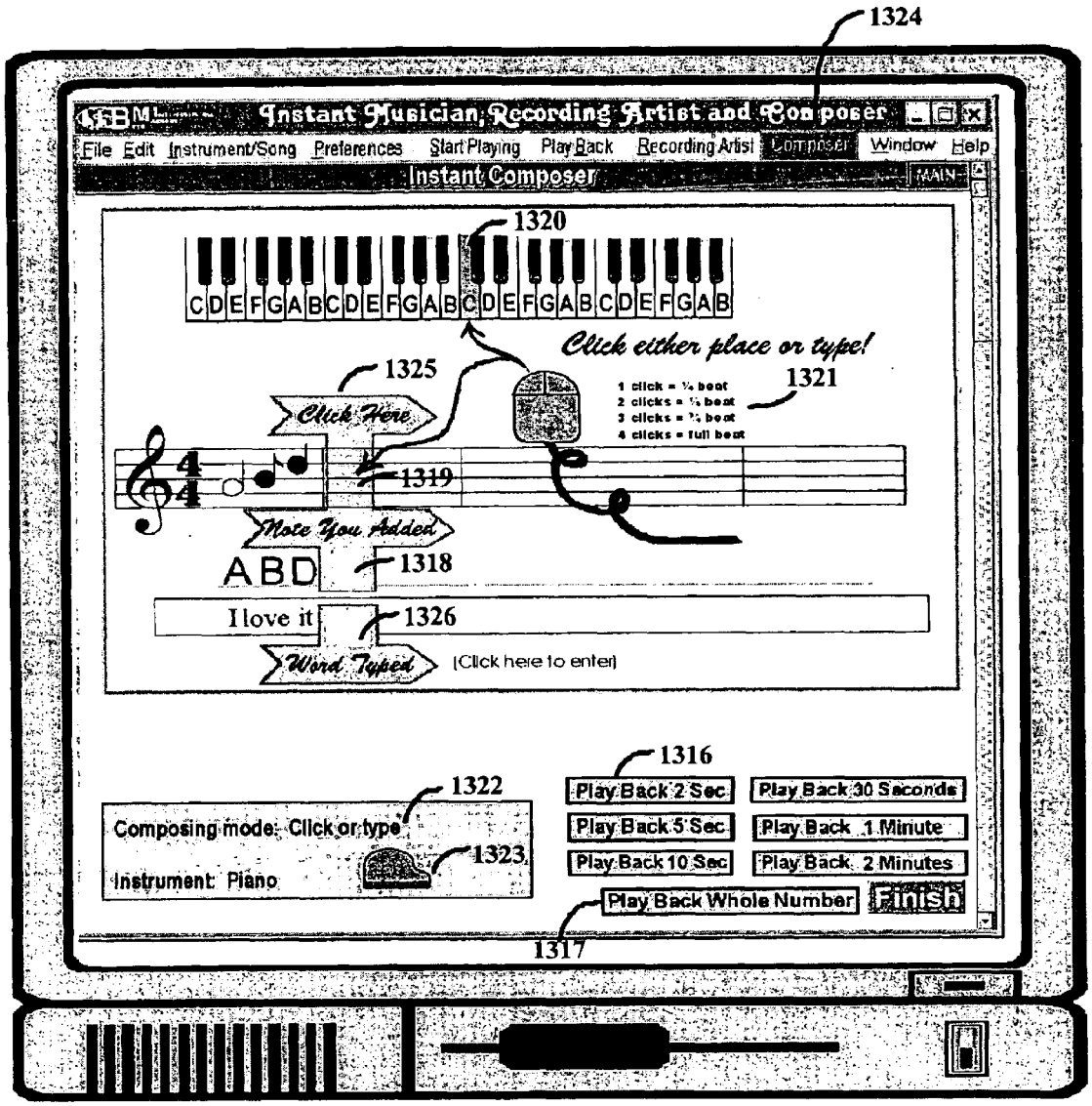
FIG. 23 shows one embodiment of a display in the "Instant Composer" aspect of the present invention that allows users to compose their own music by typing, or pointing and clicking on either music scores or displayed musical instruments.

FIG. 23 illustrates the use of the "Click or Type" composing mode where the user either types a note (1118) or points and clicks a note on to the music score (1319) on the screen. Alternatively, the user of the system may point and click on a instrument depiction (1320) to add a note to the music score and to add the letter of the note added to the current note window (1325). As noted on the display, there is a guide displayed in the present embodiment that indicates how to create music notes of different time durations (1321). If typing was the method preferred by the user, different note time durations are designated via keying in additional notes (function keys, control key, shift key, alt key, arrow keys, etc.) depending on the composer setup and preferences (1305) selected by the user.

The composing mode is noted on the display (1322) as well as the instrument that was selected (1323) to play for hearing the music piece as the composing proceeds or when the composer elects to hear various length segments that have been composed. As seen on the display, music segments played back range from the last two seconds of music composed (1316) to having the computer play back every bit of the music number composed (1317).

At any time the composer may select the main Instant Compose menu (1324) and change music settings including the musical instrument (1315) selected to play back segments of the music that has been composed. To change any particular note that has been previously placed into the music score in the composing precess, the composer first either drags the current note placement window (1325) to the note wished to be changed or uses computer keyboard keys such as "Backspace," arrow keys, or other depending on the user preferences selected (1305). Then with the note placement window (1325) over the note wished to be modified, the composer then actuates the delete key on the computer keyboard or the right button on a mouse or other pointing device to delete the desired key wished to be changed. Upon the deletion of the note wished to be changed, the user is then free to add a different note to the music score by either clicking or typing as was done originally in the composing process. As noted in FIG. 23, there is also a space in the current music note window (1325) for adding words (1326) to the music being composed.

Figure 24:
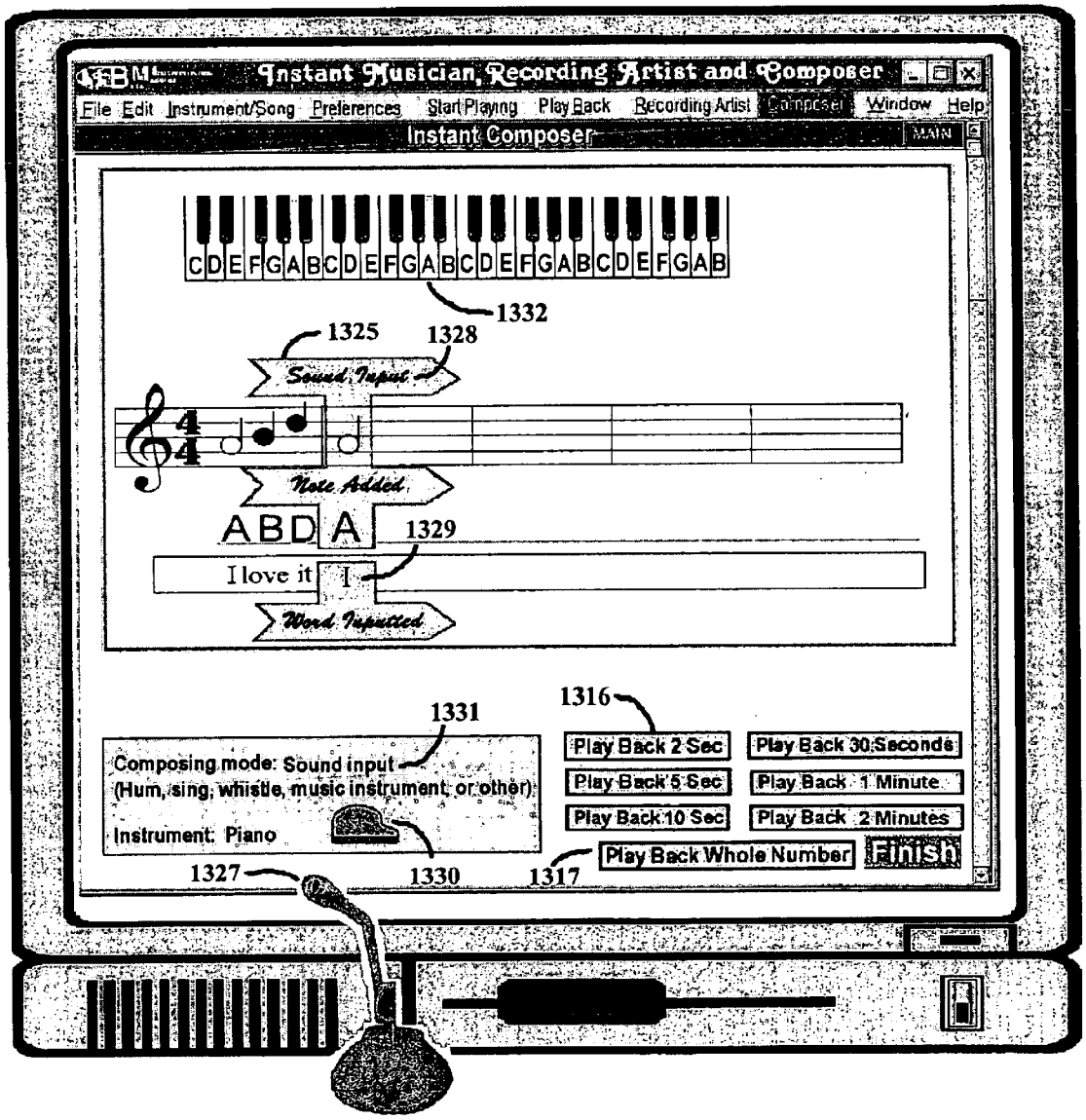
FIG. 24 shows one embodiment of a display in the "Instant Composer" aspect of the present invention that allows users to compose their own music by inputting vocal or other sounds.

FIG. 24 illustrates one embodiment of the Instant Composer display screen where the composing by sound inputs have been selected from a sub-menu of the Instant Composer menu (1308). Sound inputs for this purpose may be singing, humming, whistling, tapping something, music playing in background or the playing of a real musical instrument. With this composing option selected, the music score is automatically filled with notes inputted to the computer via the computer's voice input device or microphone (1327). As noted on the current music note window (1325), some of the window labeling is changed in accordance with the vocal input that is used to direct the music note placement. "Sound Input"(1328), for example, replaces "Click Here" that was used when the music input mode in progress was "Clicking or Typing." Depending on user setup preferences selected (1305), words may be either automatically generated for the musical number being composed (if composer sings to compose), or the user may input words via the "Word Inputted" window (1329) in the current music note window (1325). In accordance with the present embodiment, any standard voice recognition software package may be interfaced with the current invention to translate the composer's singing into words, or this function may be embedded, while the present invention translates the composer's singing or other inputted sounds into appropriate musical notes. This translation of the composer singing or other sound inputs into musical notes is done by computer software that detects the frequency level and duration of inputted sounds and converts them into notes on the music score representing the appropriate note designation for the note frequency or pitch (notes a, b, c, etc.) plus the appropriate note durations (1/8, 1/4, 1/2, etc.) including music note sharps and flats, as appropriate. As in other modes of composing music, there is a display of the composing mode in progress (1331) plus the instrument sounds chosen to hear segments of the music being composed. Unlike the "Click or Type" inputting mode option selection, however, music notes inputted via the microphone (1327) or other sound input devices are not simultaneously sounded by the computer as they are being inputted in this mode. To hear music segments composed in this manner, the "Play Back" controls ranging from play back two seconds (1316) to play back whole number (1317) must be actuated.

Figure 25:
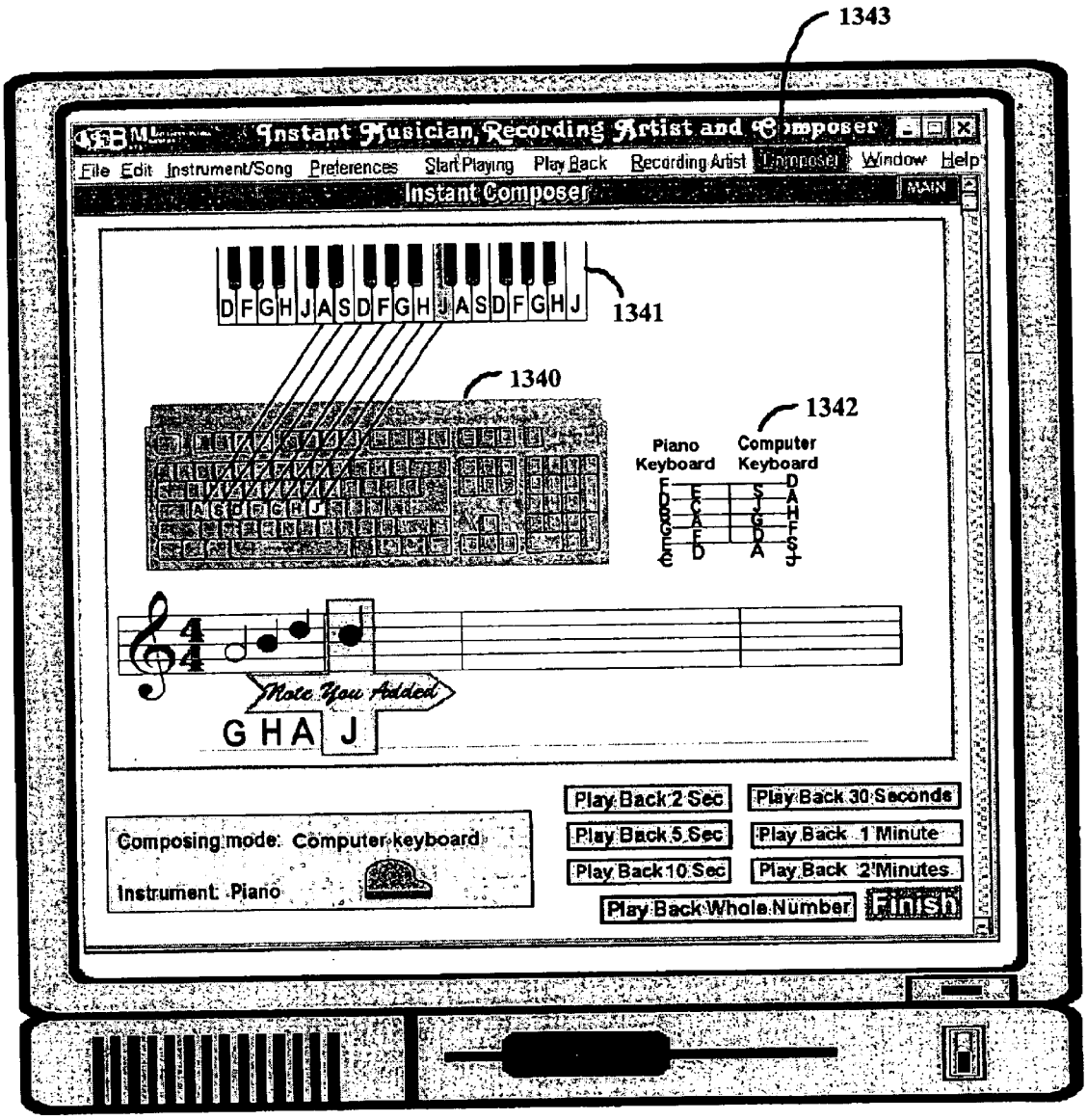
FIG. 25 shows one embodiment of a display in the "Instant Composer" aspect of the present invention that allows users to compose their own music by typing on a computer keyboard that emulates a piano or organ keyboard.

FIG. 25 is one embodiment of a display for allowing a computer user to use still another way of inputting notes to compose a music number. This approach to composing uses a conventional computer keyboard (1340) to simulate a keyboard of a piano, organ or other conventional instruments that use keyboards with a linear array of keys where each adjacent key gives rise to higher or lower sounds (depending on which direction—right or left). Moreover, by employing conventional computer keyboard lettering on the image of a conventional instrument keyboard (1341), the computer keyboard (1340) is given more of the feel of a conventional instrument keyboard which will assist composing. While the example shown uses keyboard keys (1342) roughly matching the physical linear array of keys on a piano or similar instrument, users may select other matching arrangements of their choice via user preferences available from the main Composer menu (1343). Another choice may be to match the conventional music "middle C" with a computer keyboard "A" key instead of what would be a "J" key in the example. Different options are also available for shifting octaves like using the computer shift key, arrow keys, etc.

Figure 26:
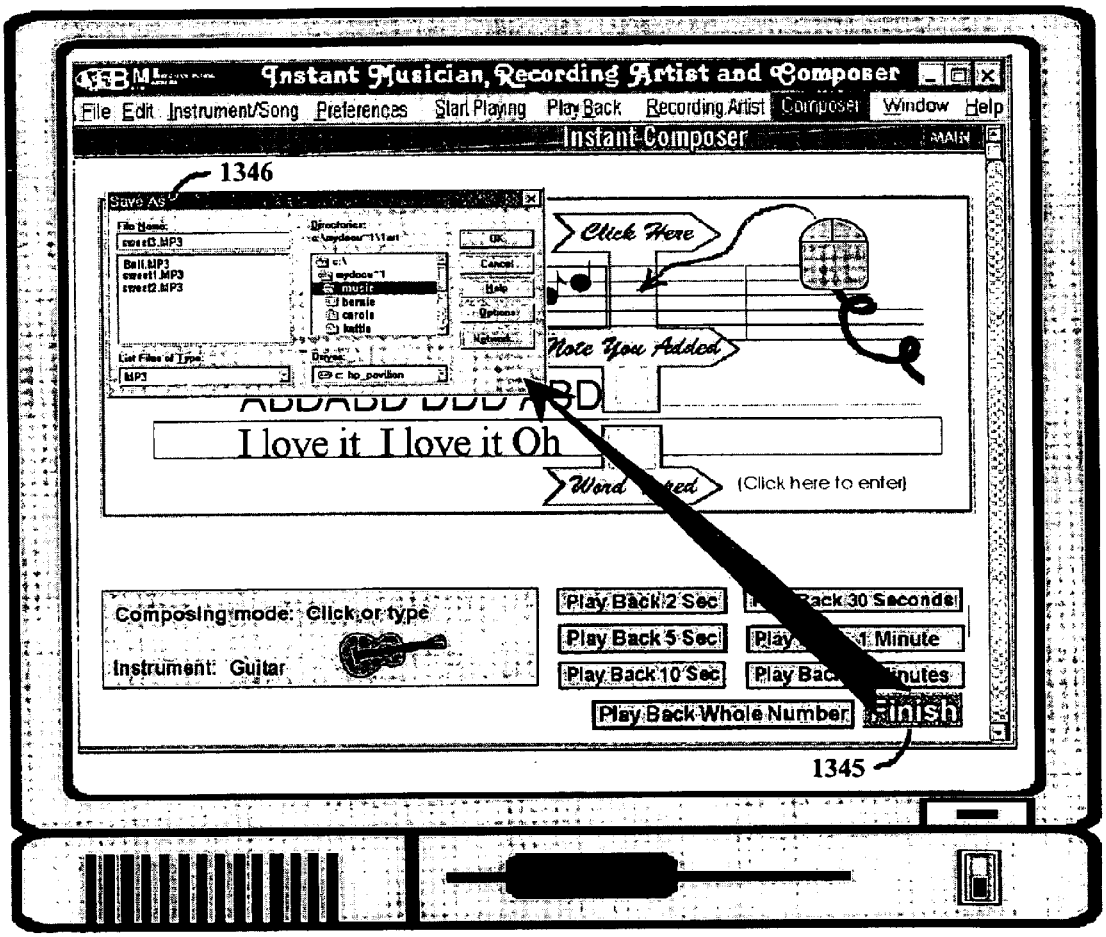
FIG. 26 shows one embodiment of a display in the "Instant Composer" aspect of the present invention that allows users to save files containing music they composed.

FIG. 26 illustrates how music composed by the Instant Musician, Recording Artist and Composer system is saved for the purposes of later listening or later modification. Actuating the "Finish" control (1345) brings up a "Save As" dialog box (1346) where the music composed may be saved in any common music format.

Figure 27:
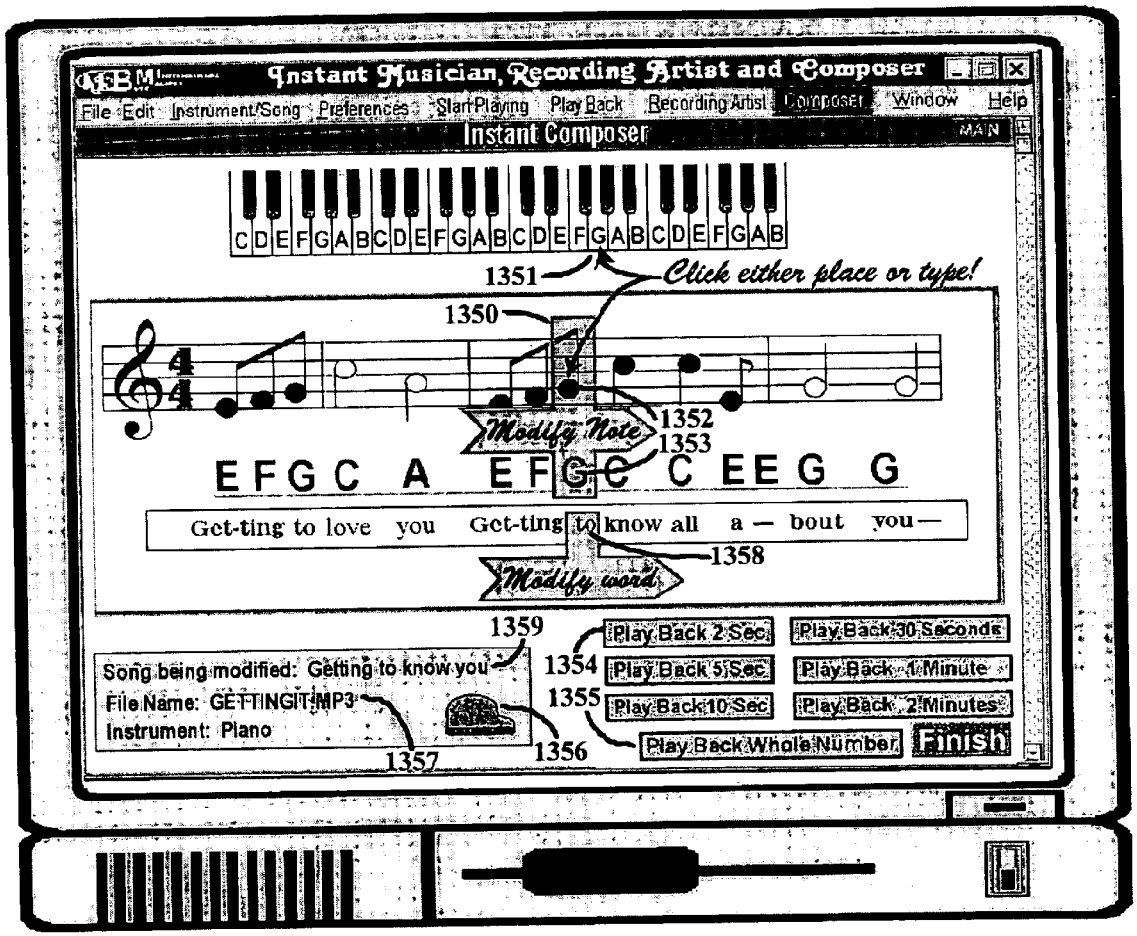
FIG. 27 shows one embodiment of a display in the "Instant Composer" aspect of the present invention that allows users to compose music by modifying previously composed music.

Any music file either composed using the Instant Musician, Recording Artist or Composer system or composed in some other manner may be modified by the system. FIG. 27 shows the display for a file that was opened using the "Compose by Modification" selection from the Instant Composer menu (1303) shown in FIG. 22. Any music note(s) shown in the music score opened may be modified. The procedure is to either type or click the new note desired in the appropriate place in the current note window when the window (1350) is positioned over the note(s) desired to be changed. To enter the change, the user may either click on the desired key on the musical instrument shown (1351), click on the music score (1352) or type the letter of the new note desired (1353). Words to the music number, if there are any, may be modified by selecting the part of the current music note window associated with the music number's words (1358) and modifying the word(s) as desired by deleting what's there and retyping in a new word in its place.

After a change, or changes, the user may play back the music modified by actuating the desired "Play Back" control. These "Play Back" controls range from two seconds (1354) to playing back the whole music number (1355). As with other modes of the Instant Composer, the musical instrument sounds used to play back music numbers is selected by the user. In the example shown in FIG. 27, the instrument sounds selected by the user for composing and playback purposes are piano sounds (1356). Also to be noted in the display is the notation of the file name of the music being modified (1357) and a name for the original music number associated with the music that was selected to be modified (1359).

Figure 28:
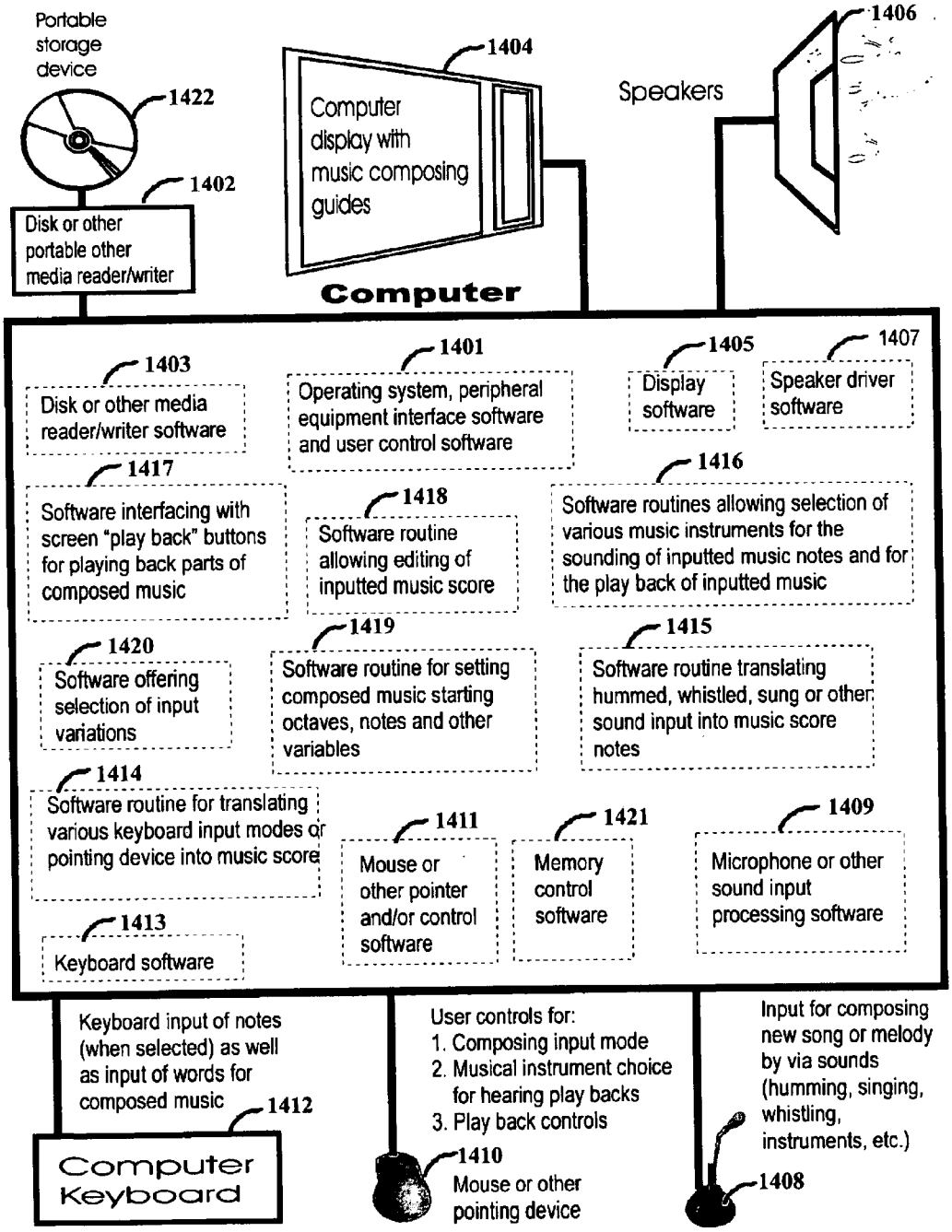
FIG. 28 shows a block diagram of the general hardware and software construction of the "Instant Composer" aspect of the present invention.

Key elements of the Instant Composer embodiment of the invention are depicted in FIG. 28. Elements of the system common to most computers include the operating system (1401) that manages all of the software routines and computer peripheral devices including the removable disk or other portable media reader and writer (1402), an associated media reader software (1403), computer display (1404) and associated display software (1405), computer speaker(s) (1406) and associated computer speaker software (1407), computer microphone or other sound sensing device(s) (1408) and associated sound input processing software (1409), mouse or other pointing device (1410) and associated software (1411), standard computer keyboard (1412) and associated software (1413). Unique to this aspect of the current invention are several software routines containing algorithms that work with the standard peripheral devices to produce and/or modify music scores. These include the software routines for processing user keyboard inputs or pointing device inputs in music scores on the display (1414), routines with algorithms for processing sounds via the computer's sound sensing device into music score notes (1415), software routines allowing selection of various musical instrument sounds for inputting and playing back composed music (1416), and software for allowing composers to play back various durations of music being composed (1417). The system also has routines allowing the editing of inputted music scores (1418). There also is software for selecting and changing music starting octaves, note time signatures and other variables (1419) and well as software offering selection of various input variations (1420). The system memory control software (1421) in conjunction with the disk or other portable media interface software (1403) allows composed music to be stored on disks (1422) (CD-RWs, CD-R/RWs, floppies, ZIP disks, etc.) as well as allows the system to input digital music previously composed and recorded from the Instant Musician, Recording Artist and Composer system or from other sources for the purpose of playing and/or modifying the music and associated lyrics or words.

While examples of this invention in terms of displays and system functional diagrams have been shown and described, other variations of the Instant Musician, Recording Artist and Composer system will be apparent to those skilled in the art without departing from the spirit of the invention. Therefore, it should be understood that the embodiments shown in the drawings and described are merely for illustrative purposes, and are not intended to limit the scope of the invention, which is defined by the appended claims.

What is claimed is:

1. An integrated music system for use on a personal computer by users without any music background or knowledge comprising sub-systems consisting of a music playing sub-system, music recording/altering sub-system and music composing sub-system where the personal computer based music playing sub-system provides users a means to select and play numerous different musical numbers by means of typing letters displayed on the computer's display using the computer's standard computer keyboard and have the letters typed generate musical note sounds from the computer's sound system correspond to one of many different musical instrument sounds offered to the user for playing selected music numbers with said system apparatus comprising:

computer readable program instructions for executing the functions of the personal computer music playing sub-system including presenting on the computer display the sequence of standard computer keyboard keys to be pressed on the standard computer keyboard to activate the sounding of correct seguence of stored musical note sounds corresponding to the instrument and music number selected by the computer user; and storage means readable by computer readable media for storing a plurality of data sets or databases having all single musical note computer keyboard designations from an all inclusive sample music score covering each possible musical note tied in the database to recorded single musical notes from the actual sounds of a plurality of all known musical instruments including all musical note sounds of accordions, bugles, clarinets, cymbals, drums, flutes, guitars, harps, organs, pianos, saxophones, trumpets, tubas as well as other known musical instruments; and storage means readable by computer readable media for storing a plurality of data sets or databases for a plurality of musical numbers or songs in which classical representations of musical notes and other musical score symbols are related in the database to keys on standard computer keyboards; and display means and computer pointing device activation means and/or computer keyboard means for allowing users to select a particular stored musical number to play by pressing the standard computer keyboard key sequences displayed on the screen from a plurality of stored music numbers in addition to the display of the traditional music score of the selected music number; and display means and computer pointing device activation means and/or computer keyboard means for allowing users to select which musical instruments sounds are to be sounded when standard computer keyboard keys are actuated in addition to the display of the musical instrument selected; and display means for highlighting the particular part (key, button, slide, etc.) of the music instrument selected that corresponds to the current note of the music score displayed; and sound generation means for having personal computers generating sounds of stored musical note sounds of musical instruments when directed by the system software program in response to user personal computer keyboard key actions; and sound pickup means for picking up and recording sounds detected by a microphone or other sound pickup device connected to the system personal computer.

2. An integrated music system for use on a personal computer by a user without any music background comprising sub-systems consisting of a music playing sub-system, music recording/altering sub-system and music composing sub-system where the music record/altering sub-system provides users a means to record, modify and combine music numbers with modifications including both music sound amplitude and frequency transformation modifications in selected frequency bands of selected previously recorded music numbers where the frequency transformation operations permit the generation of new sounds in frequency bands not generated in the original recordings and/or previously combined recordings with such sub-system comprising:

a process of generating combined displays of both the frequency spectrum analyzer and equalizer input functions in addition to frequency transformation screen-based input sections where users may depict desired frequency transformation desired previously recorded music files in addition to amplitude modifications in user inputted music frequency bands; and a process of selecting and combining one or more music numbers previously recorded for combining with user inputted relative volume modifications, user inputted equalizer actions and frequency transformations; and a process for generating displays simultaneously for each selected music number showing frequency spectrums of previously recorded music, superimposed equalizer settings selected by the user, user selection of frequency transformation settings, music frequency spectrum amplitudes as a result of equalizer and frequency transformation inputs by the user, relative volume control settings, file names for music being combined, other descriptive labeling, including file names, and the depiction of the instrument or other sound generation source used to generate each selected music source; and a process for saving altered or combined music files in file formats selected by the user.

3. An integrated music system for use on a personal computer by a user without any music background comprising sub-systems consisting of a music playing sub-system, music recording/altering sub-system and music composing sub-system where the music composing sub-system provides users a means to automatically compose or create new music numbers having music scores, words and recorded music sounds automatically with such composed music pieces being able to be generated by several different personal computer input means including:

generating new music scores by inserting notes into blank music scores with a computer mouse pointing device and having the inserted note create a corresponding musical note sound for the last note or set of notes entered into the music score using the sound of a chosen musical instrument, and generating new music score notes on music scores automatically by using a mouse pointing device to in effect actuate the keys, buttons, slides, drums, symbols or other musical instrument input devices displayed on a personal computer screen depiction of a selected musical instrument where each mouse or other computer pointing device pointing action on the computer screen depiction of the chosen musical instrument creates a corresponding note on the computer screen depicted musical score along with the corresponding computer sound system created musical instrument sound, and by generating music notes on a score by processing sounds inputted from a microphone or other sound pick up device to the personal computer including sounds made by the user by humming, whistling, singing, musical instrument playing, and by composing new music numbers by modifying music scores of previously recorded music numbers by mouse pointing device actions on the displayed music scores of these previously recorded music numbers, and with such music composing sub-system comprising:

a storage means readable by computer readable media for storing a plurality of data sets or databases having all single musical note designations from an all inclusive sample music score covering each possible musical note tied in the database to recorded single musical notes from the actual sounds of a plurality of musical instruments including all musical note sounds of accordions, bugles, clarinets, oymbals, drums, flutes, guitars, harps, organs, pianos, saxophones, trumpets, tubas as well as other known musical instruments; and a display means for displaying music scores generated by a variety of computer input means including: typing keys on a standard computer keyboard, pointing and clicking on displayed music scores using a mouse or other pointing device, or generating music scores from sounds picked up via a computer microphone or other computer sound input device produced by the system user who may produce sounds by humming, singing, whistling, musical instrument playing or by modification of previously recorded music scores via mouse dragging or other mouse operations or other pointing devices on music scores displayed; and a sound generation means using a personal computer sound system for generating sounds of notes generated for music scores using sounds of instruments selected by user; and a sound pickup means for picking up and recording sounds detected by a microphone or other sound pickup device connected to the system computer.

4. The personal computer music playing sub-system as in claim 1, wherein the computer readable program instructions allow displaying words or lyrics of musical numbers selected from databases of music numbers along with standard computer keyboard key sequences displayed that produce the sounds of the selected musical instrument sounds for the selected musical number chosen when these standard computer keyboard keys are actuated by the user in the order presented on the computer display.

5. The system as in claim 1, wherein in the correlations between user typed keys on a standard computer keyboard and the musical notes interpreted by the system may be changed by the user to make sounds generated by the computer sound system from user keyboard entries represent other musical instrument sounds for any musical numbers selected.

6. The system as in claim 1, wherein the musical instrument sounds generated by user keyboard input actions may be changed by the user to the sounds of different musical instruments, like changing the sounds of the computer keys being played from that of the sounds of a piano to the sounds of a flute.

7. The system as in claim 1, wherein the sounds created by the user from playing a music number from the computer keyboard keys are recorded on computer writeable portable storage devices.

8. The system as in claim 1, wherein a method of communication with the Internet is included for the purpose of downloading into the computer's memory or storage devices additional musical numbers complete with the correlations between standard keyboard keys and the notes of displayed music scores.

9. Computer readable program instructions containing executable instructions, in accordance with claim 1, for executing:

a process of selecting a music number to be played by the user via a mouse, other pointing device or from standard computer keyboard key pressing from a database of stored musical numbers where music numbers may be played or sounded from the computer sound system by simply typing standard computer keyboard letters presented on the computer display; and a process of selecting a set of specific musical instrument note sounds to be sounded from standard computer keys when depressed from a database of many musical instrument sounds stored in the database; and a process for accepting user preference inputs on display options pertaining to whether the user prefers having a current musical note window to move over the current musical note to be displayed or whether the user prefers the music score to move on the display with the current music note window fixed in place on the display; and a process for allowing the user to elect whether a background music rhythm or accompaniment with a regular systematic beat is to be added to music sounds created by the user's typing letters displayed on the computer screen and a process for selecting the relative volume and instrument sound of a background rhythm or accompaniment, if chosen.

10. Computer readable program instructions containing executable instructions, in accordance with claim 1, for executing a process of accepting user preference on whether the music number to be played by depressing computer keyboard keys shall be accompanied by the sounds of a second instrument that provides a periodic musical sound, and preferences related to the round level and pitch of the second musical instrument sounds.

11. The music recording/altering sub-system as in claim 2, said sub-system comprising:

computer readable program instructions for executing the functions of the music recording/altering sub-system that includes a frequency spectrum analyzer for computing the real-time frequency spectrum of previously recorded music numbers played by the system; and display means for displaying the frequency spectrum analyzer functions of single or multiple previously recorded music numbers chosen to be combined and the function of transmitting on screen frequency transformation information entered by mouse or pointing device movement on of music recordings being played to the computer frequency transformation algorithms; and storage means for storing music numbers being combined and the music number produced by combining and/or modifying music files; and sound generation means for generating sounds on a personal computer sound system produced by combining previously recorded and/or modified music files; and sound pickup means for picking up and recording sounds detected by a microphone or other sound pickup device connected to the system computer.

12. The system as in claim 2 or 11, wherein frequency spectrums of music previously recorded are altered to different frequencies by user settings on the display.

13. The system as in claim 2 or 11, wherein the transformed frequency spectrum of previously recorded music is shown on the display along with the user's input of frequency transformations.

14. Computer readable program instructions containing instructions, in accordance with claim 3, for executing:

a process of selecting the manner in which music is to be composed from choices of computer keyboard input and/or mouse or other pointing device input, microphone input of humming, singing, whistling, musical instrument input or other sound input, or music composing by modification of a previously recorded music score; and a process of generating blank music scores for display and a process for inserting selected music time signatures on the display; and a process of generating user preferences for the manner in which music is to be composed and the computer keyboard to music note relationships desired by the user; and a process for enabling the user to select the instrument sounds to be played upon entering notes into a music score displayed or when the user elects to play back segments of the music composed; and a process for generating a display depicting the music instrument selected corresponding to sounds generated during play back time segments; and a process enabling the user to save composed music in file formats of choice; and a process enabling users to select, open and process previously recorded music files complete with the automatic generation of music score displays for the purposes of composing new music numbers by modification of previously recorded music numbers; and a process of enabling users to enter words to music being composed by use of the computer keyboard or with the assistance of voice recognition software; and a process for the user to play back several different time durations of music composed.

* * * * *